US011264747B2

(12) United States Patent
Yang et al.

(10) Patent No.: US 11,264,747 B2
(45) Date of Patent: Mar. 1, 2022

(54) ELECTRICAL CONNECTOR WITH MATE ASSIST HAVING FEEDBACK

(71) Applicant: Molex, LLC, Lisle, IL (US)

(72) Inventors: Xiaojian Yang, Rochester Hills City, MI (US); Bradley M. Dick, Rochester Hills City, MI (US); Aaron Puetz, Rochester Hills City, MI (US)

(73) Assignee: Molex, LLC, Lisle, IL (US)

( * ) Notice: Subject to any disclaimer, the term of this patent is extended or adjusted under 35 U.S.C. 154(b) by 130 days.

(21) Appl. No.: 16/513,751

(22) Filed: Jul. 17, 2019

(65) Prior Publication Data

US 2020/0412040 A1 Dec. 31, 2020

(30) Foreign Application Priority Data

Jun. 26, 2019 (CN) ..... 201910559024.3

(51) Int. Cl.
*H01R 12/71* (2011.01)
*H01R 12/72* (2011.01)
(Continued)

(52) U.S. Cl.
CPC ..... *H01R 12/724* (2013.01); *H01R 13/6273* (2013.01); *H01R 13/62905* (2013.01); *H01R 13/62938* (2013.01); *H01R 12/716* (2013.01)

(58) Field of Classification Search
CPC ..... H01R 13/6273; H01R 13/62905; H01R 13/62938; H01R 13/62955;
(Continued)

(56) References Cited

U.S. PATENT DOCUMENTS 5,320,544 A * 6/1994 Naoto ..... H01R 13/62938 439/157
5,938,458 A * 8/1999 Krehbiel ..... H01R 13/62938 439/157
6,168,445 B1 * 1/2001 Seutschniker ... H01R 13/62977 439/157
(Continued)

FOREIGN PATENT DOCUMENTS

CN 101044658 A 9/2007
CN 101044659 A 9/2007
(Continued)

OTHER PUBLICATIONS

JP office action received for Application No. 2020-102799, dated Jul. 6, 2021, 8 pages (4 pages of English Translation and 4 pages of original documents).

*Primary Examiner* — Edwin A. Leon
*Assistant Examiner* — Milagros Jeancharles

(57) ABSTRACT

A connector has a housing configured to mate with a second housing, a pair of slide members movably mounted on the housing, and a lever pivotably attached to the housing and slidably coupled to the slide members. Each slide member has a cam groove in a side surface which provides an angled lead-in surface into the cam groove and cam surfaces engageable with a cam follower post of the second housing. A blocking shoulder partially blocking an opening of the cam groove to prevent entry of the cam follower post unless the cam follower post is in a correct position. When the cam follower post engages the angled lead-in surface, this provides a visual and tactile indication to a user that the connector is ready to be mated with the second housing.

14 Claims, 30 Drawing Sheets

(51) Int. Cl.
*H01R 13/627* (2006.01)
*H01R 13/629* (2006.01)

(58) Field of Classification Search
CPC ..... H01R 13/62933; H01R 13/62922; H01R 13/62977; H01R 13/62961; H01R 13/62911; H01R 13/629; H01R 12/716; H01R 12/724
See application file for complete search history.

(56) References Cited

U.S. PATENT DOCUMENTS 6,382,992 B1 * 5/2002 Bouchan ..... H01R 13/62911 439/157
7,347,704 B2 * 3/2008 Tsuji ..... H01R 13/62927 439/157
10,566,728 B1 * 2/2020 Sundarakrishnamachari ..... H01R 13/639
2006/0040536 A1 * 2/2006 Putnam ..... H01R 13/641 439/157
2007/0099461 A1 * 5/2007 Pittenger ..... H01R 13/62977 439/157
2009/0305536 A1 12/2009 Martin

FOREIGN PATENT DOCUMENTS

| | | | |
|---|---|---|---|
| CN | 101199087 | A | 6/2008 |
| CN | 101218716 | A | 7/2008 |
| CN | 101299500 | A | 11/2008 |
| CN | 102255174 | A | 11/2011 |
| CN | 103460519 | A | 12/2013 |
| CN | 104638451 | A | 5/2015 |
| CN | 108736250 | A | 11/2018 |
| JP | 2003272750 | A | 9/2003 |
| JP | 2014099267 | A | 5/2014 |
| JP | 2014165031 | A | 9/2014 |
| JP | 2017073203 | A | 4/2017 |
| WO | 2010060828 | A1 | 6/2010 |

* cited by examiner

ELECTRICAL CONNECTOR WITH MATE ASSIST HAVING FEEDBACK

RELATED APPLICATIONS

This application claims priority to Chinese Application No, 201910559024.3, filed on Jun. 26, 2019, which is incorporated herein by reference in its entirety.

FIELD OF THE INVENTION

The present disclosure relates to field of electrical connectors, in particular, electrical connectors used in a vehicle harness and having a mate assist mechanism.

DESCRIPTION OF RELATED ART

A typical lever-type electrical connector assembly includes a first actuator connector which has an actuating or mating assist lever rotatably mounted thereon for connecting and disconnecting the actuator connector with a complementary second mating connector. The actuating lever and the mating connector typically have cam groove/cam follower arrangement for drawing the mating connector into mating condition with the actuator connector in response to rotation of the lever.

A common structure for a lever-type electrical connector of the character described above is to provide a generally U-shaped lever having a pair of arms which are disposed on opposite sides of the actuator connector. The arms may have cam grooves for engaging cam follower projections or posts on opposite sides of the mating connector.

Such lever-type electrical connectors often are used where large forces are required to mate and unmate a pair of connectors. For instance, terminal and housing frictional forces encountered during connecting and disconnecting the connectors may make the process difficult to perform by hand. Some lever-type electrical connectors use slide members which are slidably mounted on the housing of the actuator connector for movement in a direction generally perpendicular to the mating direction of the connectors. First cam groove and cam follower means are provided between the lever and the slide members, whereby pivotal movement of the lever effects linear movement of the slide members relative to the actuator connector. Second cam groove and cam follower means are provided between the slide members and the second connector, whereby the connectors are mated and unmated in response to the lever and resulting translation of the slide members.

BRIEF SUMMARY

In an embodiment, an actuator connector has a housing configured to mate with a housing of a mating connector, a pair of slide members movably mounted on the housing, and a lever pivotably attached to the housing and slidably coupled to the slide members. Each slide member has a cam groove in a side surface which provides an angled lead-in surface into the cam groove and cam surfaces engageable with a cam follower post of the second housing. A blocking shoulder partially blocking an opening of the cam groove to prevent entry of the cam follower post unless the cam follower post is in a correct position. When the cam follower post engages the angled lead-in surface, this provides a visual and tactile indication to a user that the connector is ready to be mated with the second housing.

In another embodiment, a lever-type electrical connector assembly is provided. The connector assembly includes a mating connector having a housing with a cam post extending outwardly therefrom. The cam post having a main body and a projection extending from the main body. In some embodiments, the projection is crescent-shaped. The connector system further includes an actuator connector configured to mate with the mating connector. The actuator connector includes a housing, a pair of slide members movably mounted on the housing, and a lever pivotably attached to the housing and slidably coupled to the slide members. Each slide member has a cam groove in a side surface which provides an angled lead-in surface into the cam groove and cam surfaces engageable with the cam follower post. A blocking shoulder partially blocking an opening of the cam groove to prevent entry of the cam follower post unless the cam follower post is in a correct position. When the cam follower post engages the angled lead-in surface, this provides a visual and tactile indication to a user that the actuator connector is ready to be mated with the mating connector.

In some embodiments, the actuator connector includes a terminal retention portion mounted in a cavity of the connector housing such that a space is provided therebetween, the terminal retention portion having first and second locks that engage with terminals that pass therethrough. The terminal retention portion includes a terminal housing, a first seal attached to the terminal housing, a second seal mounted on the terminal housing and extending into the space, and an independent secondary lock movably seated in the terminal housing. The independent secondary lock can be moved to a first position relative to the terminal housing and into the space to allow terminals to pass through terminal retention portion. The independent secondary lock is movable to a second position relative to the terminal housing to engage the terminals. The independent secondary lock includes an elongated slot in communication with the space which can be engaged by a pry tool to move the independent secondary lock relative to the terminal housing.

BRIEF DESCRIPTION OF THE DRAWINGS

The present disclosure is illustrated by way of example, and not limited, in the accompanying figures in which like reference numerals indicate similar elements and in which.

DETAILED DESCRIPTION

As required, the appended figures illustrate embodiments of the present disclosure and it is to be understood that the disclosed embodiments are merely exemplary of the disclosure, which may be embodied in various forms. Therefore, specific details disclosed herein are not to be interpreted as limiting, but merely as a basis for the claims and as a representative basis for teaching one skilled in the art to variously employ the present disclosure.

Figure 1:
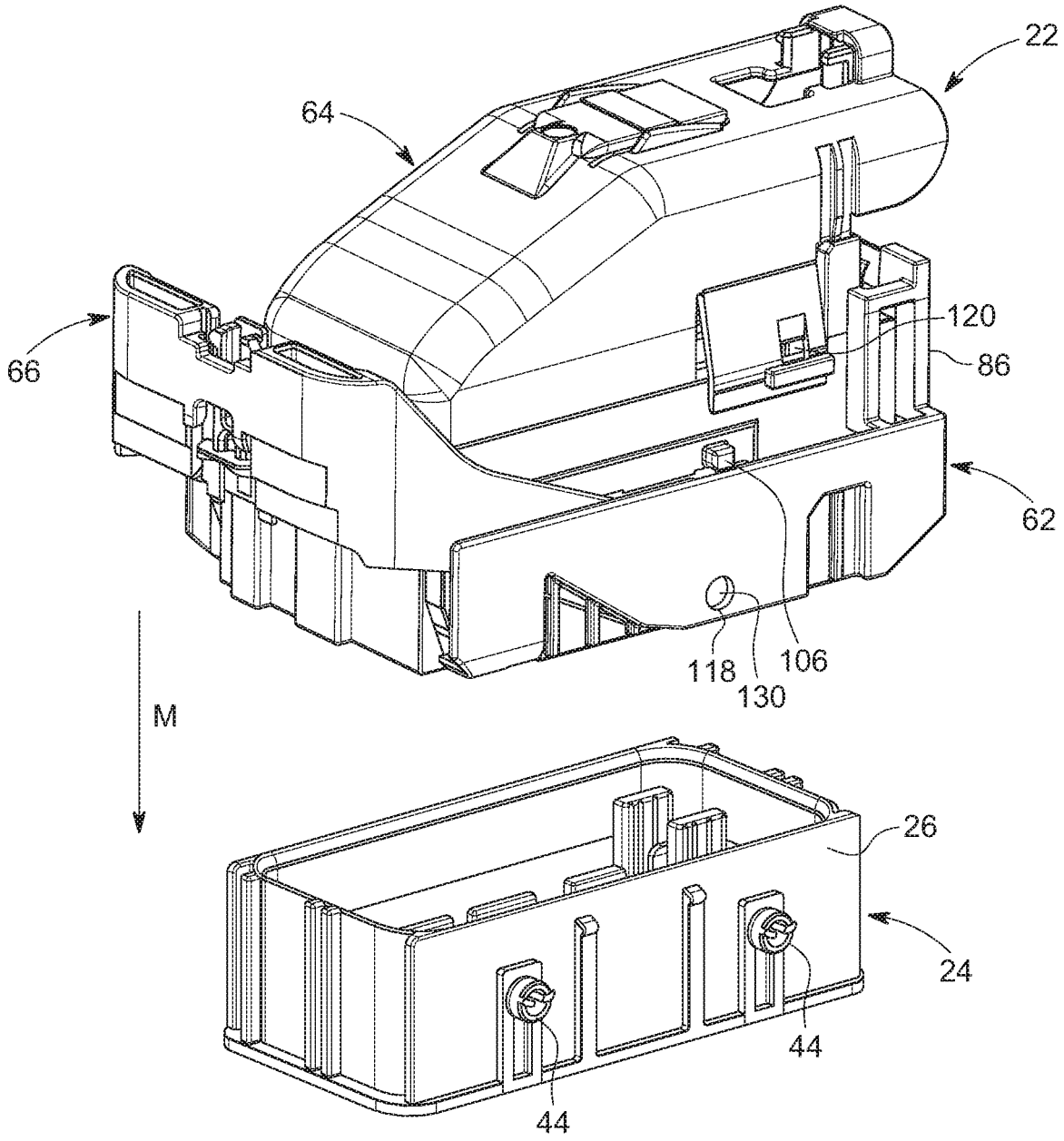
FIG. 1 depicts a front exploded view of a lever-type electrical connector assembly.
Figure 3:
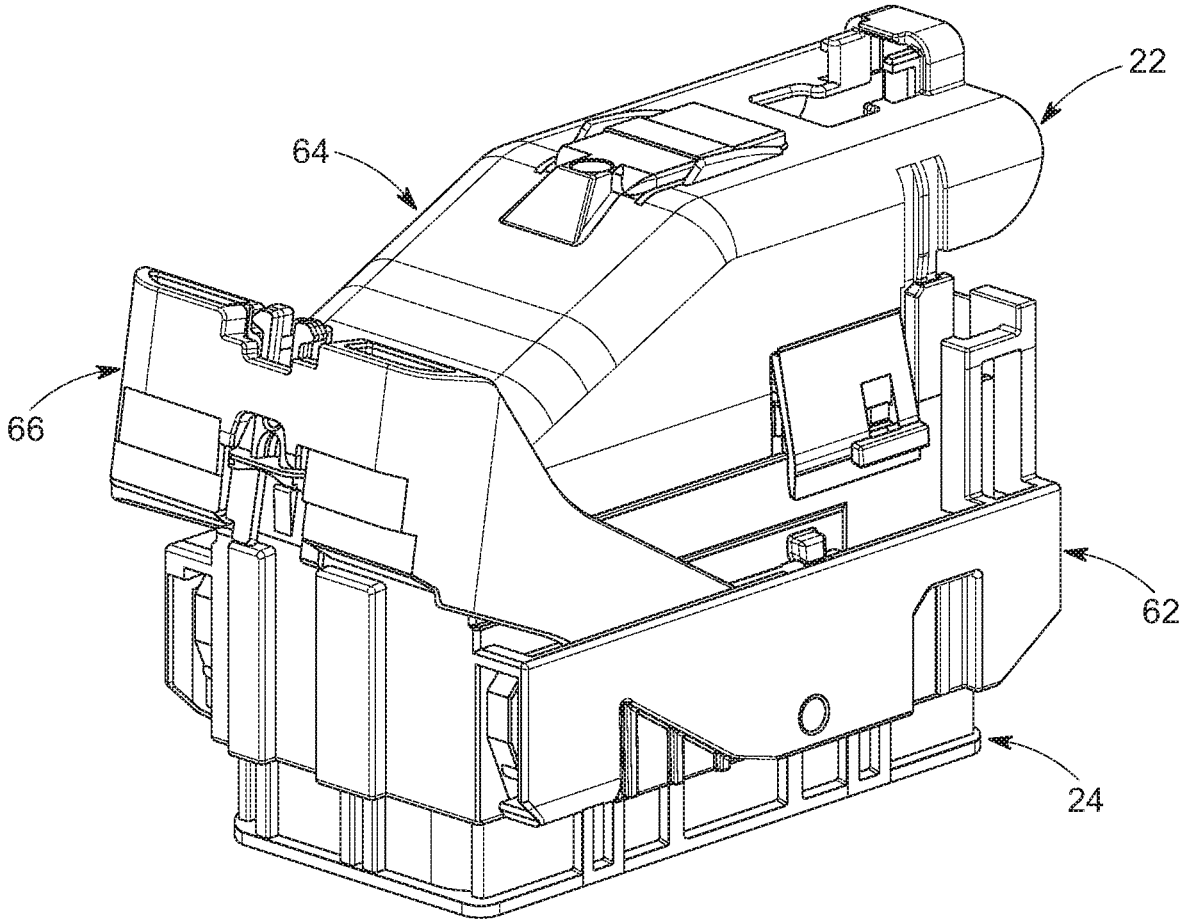
FIG. 3 depicts a perspective view of the lever-type electrical connector assembly in a ready-to mate position.
Figure 6:
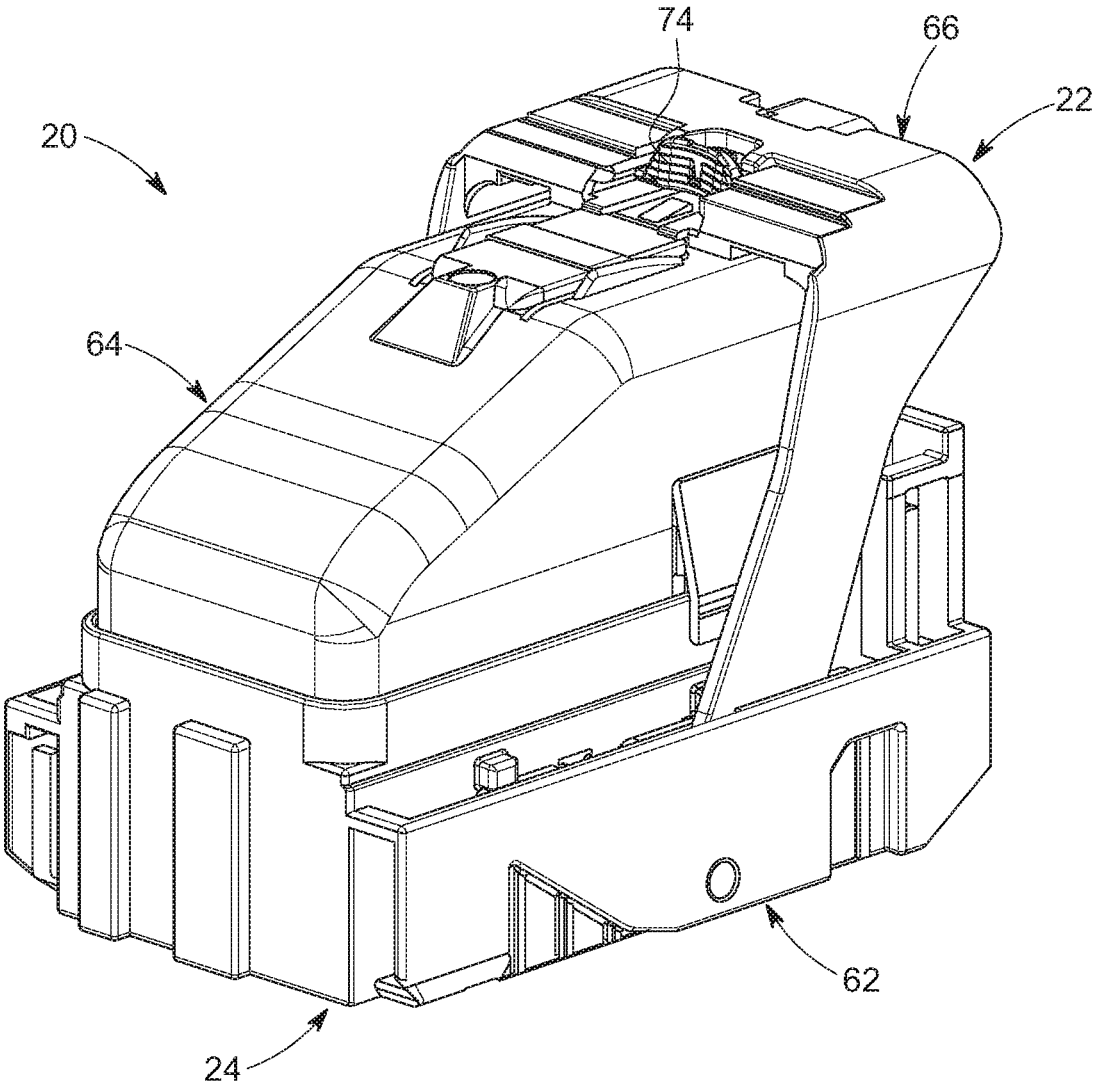
FIG. 6 depicts a front perspective view of the lever-type electrical connector assembly in an assembled position.

Referring to the drawings in greater detail, and first to FIGS. 1, 3 and 6, a lever-type electrical connector assembly 20 is provided and includes a first actuator connector 22 and a second mating connector 24. The connectors 22, 24 are shown separated in FIG. 1; in a pre-mated or "ready to mate" position in FIG. 3; and in a fully mated position in FIG. 6. The components of the lever-type electrical connector assembly 20 are described in a particular orientation ("front", "rear", "top", "bottom" and the like) for ease in description only and do not denote a required orientation in use.

The lever-type electrical connector assembly 20 provides a sealed system which is typically used in an automobile or other vehicle. Although depicted as a sealed system, the electrical connector assembly may also be used in an unsealed application. The mating connector 24 is a header connector which may be mounted on an electronics module chassis or frame in an automobile, for instance. Therefore, the lever-type electrical connector assembly 20 is applicable for use in high vibration and impact environments, although the lever-type electrical connector assembly 20 can be used in other applications. In actual practice, the lever-type electrical connector assembly 20 has been used directly on the motor chassis of a vehicle where vibrations and impacts are quite severe. This the lever-type electrical connector assembly 20 are primarily used on connectors having a high number of circuits, whereby the force required to mate the connectors 22, 24 together is increasingly high. Therefore, the lever-type electrical connector assembly 20 provides an assist to the operator for mating the connectors 22, 24 together.

Figure 8:
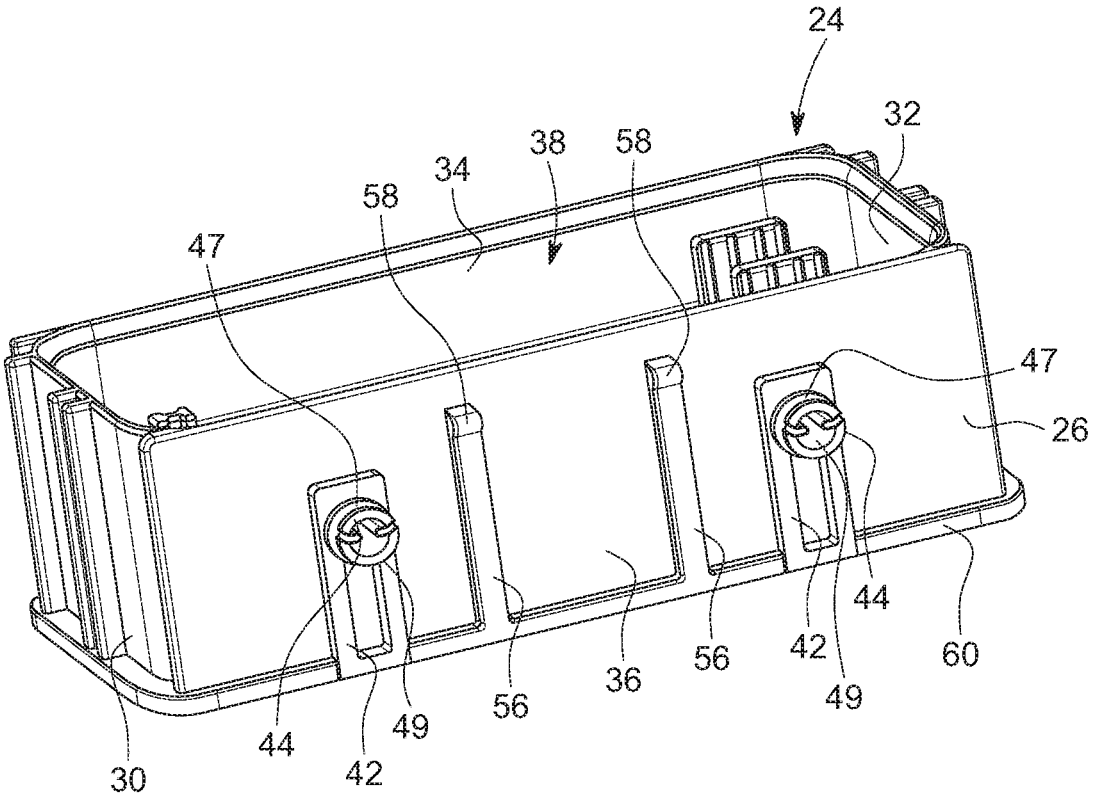
FIG. 8 depicts a front perspective view of a mating connector of the lever-type electrical connector assembly.
Figure 9:
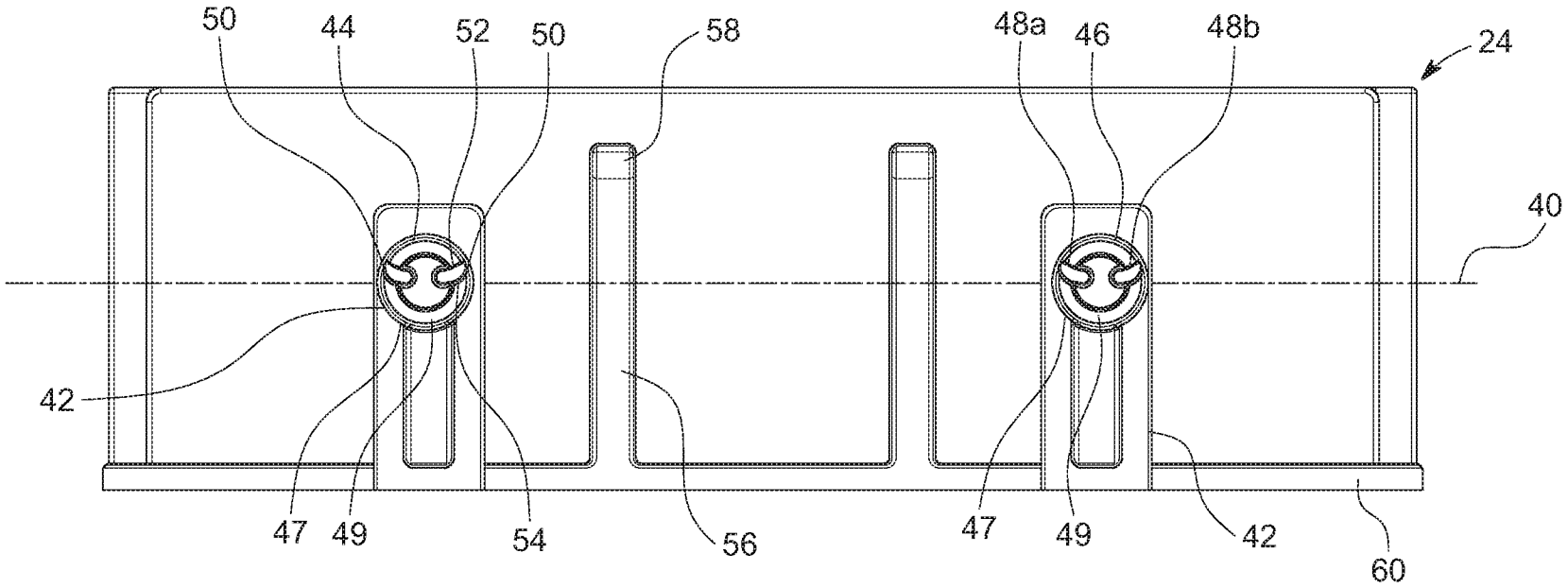
FIG. 9 depicts a side elevation view of the mating connector.

The mating connector 24 includes an insulative plug housing 26 into which the actuator connector 22 is insertable in the direction of arrow "M" as shown in FIG. 1. As best shown in FIGS. 8 and 9, the plug housing 26 is generally rectangular and has a rectangularly shaped base wall 28 at a bottom end thereof having front, rear and side walls 30, 32, 34, 36 extending upward from the outer perimeter of the base wall 28, such that an open-topped cavity 38 is formed. A longitudinal axis 40 of the plug housing 26 extends parallel to the side walls 34, 36 from the front wall 30 to the rear wall 32.

A pair of reinforcing ribs 42 extend outwardly from each side wall 34, 36 in a direction perpendicular to the longitudinal axis 40, and a cam follower post 44 projects outwardly from each reinforcing rib 42 in a direction perpendicular to the longitudinal axis 40. Each cam follower post 44 has a circular main body 46 which projects outwardly from the respective reinforcing rib 42 and has a perimeter surface 47 which defines a diameter of the cam follower post 44, and a pair of crescent shaped projections 48*a*, 48*b* extending outwardly from an outer surface 49 of the main body 46. Each crescent shaped projection 48*a*, 48*b* has a length from a curved point 50 at an outer end to an inner end thereof which is generally parallel to the longitudinal axis 40. The curved point 50 aligns with and falls along the same radius as the main body 46. A convex surface 52 of each crescent shaped projection 48*a*, 48*b* faces the top end of the plug housing 26 and a concave surface 54 of each crescent shaped projection 48*a*, 48*b* faces a bottom end of the plug housing 26. While two crescent shaped projection 48*a*, 48*b* on each cam follower post 44, only one of the crescent shaped projection 48*a*, 48*b* is used during a particular mating process. Two crescent shaped projections 48*a*, 48*b* are provided so that the mating connector 24 can be used in either direction relative to the actuator connector 22. In addition, while two separate crescent shaped projections 48*a*, 48*b* are provided on each post, the crescent shaped projections 48*a*, 48*b* can be joined together at their inner ends.

A pair of reinforcing ribs 56 extend outwardly from each side wall 34, 36 in a direction perpendicular to the longitudinal axis 40 and are positioned between the reinforcing ribs 42. A projection 58 extends outwardly from each reinforcing rib 42 in a direction perpendicular to the longitudinal axis 40.

The plug housing 26 is a unitary structure which may be molded of plastic material. A lip 60 projects outwardly from the base wall 28 and forms an interference surface which faces upward toward actuator connector 22. The plug housing 26 mounts a plurality of conductive terminals (not shown).

Figure 7:
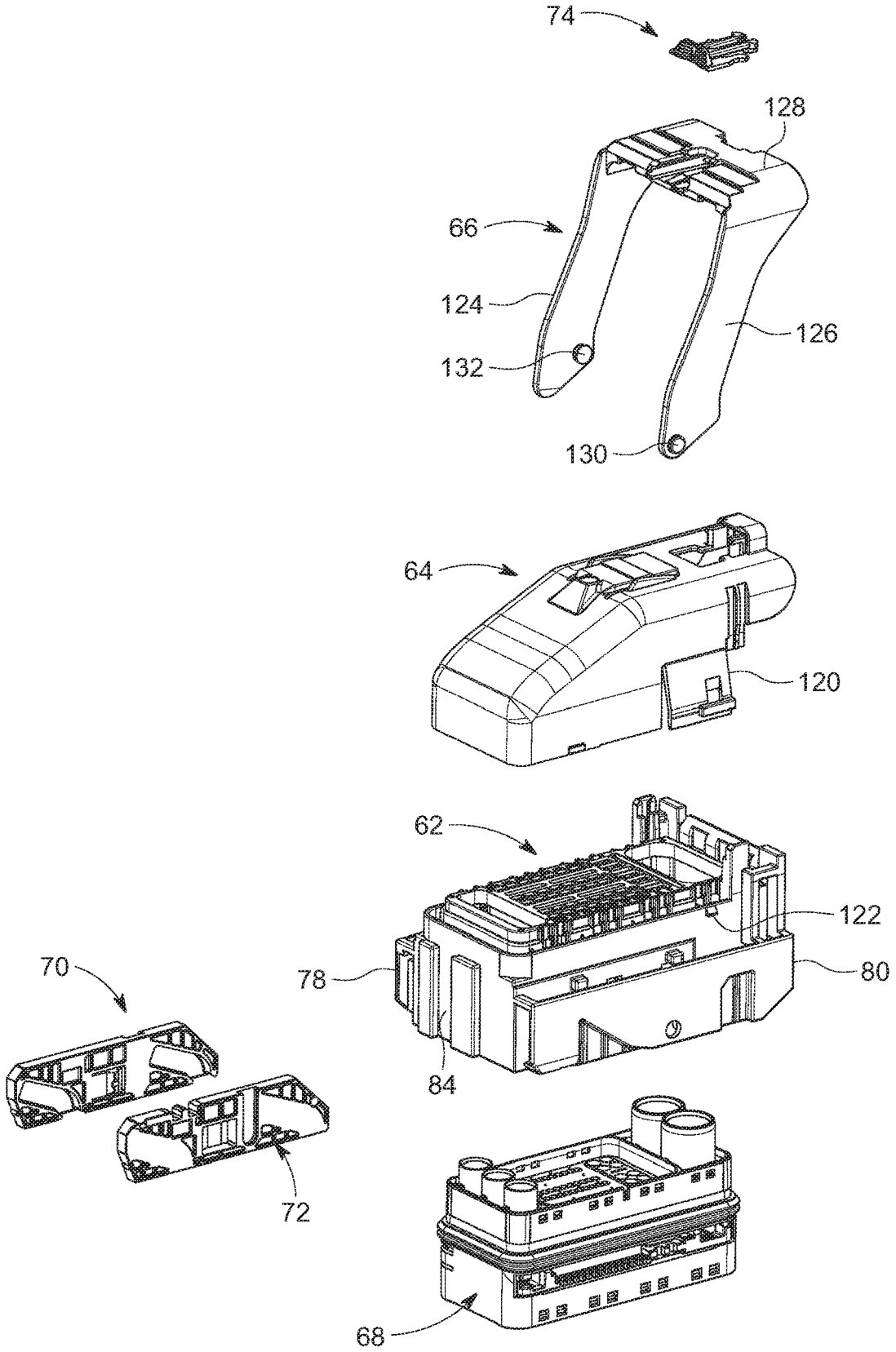
FIG. 7 depicts an exploded front perspective view of the lever-type electrical connector assembly.

FIG. 7 illustrates an exploded view of the actuator connector 22. The actuator connector 22 includes an insulative outer connector housing 62, a wire dress cover 64 which substantially covers the top of the connector housing 62, a generally U-shaped lever 66 pivotally mounted to the connector housing 62, a terminal retention portion 68 mounted in the connector housing 62, first and second slide members 70, 72 mounted to the connector housing 62 and to the lever 66, and a connector position assurance device 74 which is mounted to the wire dress cover 64 and configured to engage the lever 66 after the lever 66 is moved to the fully mated position as show in FIG. 6. The connector housing 62, the lever 66 and the slide members 70, 72 work together to form a mate assist mechanism.

Figure 10:
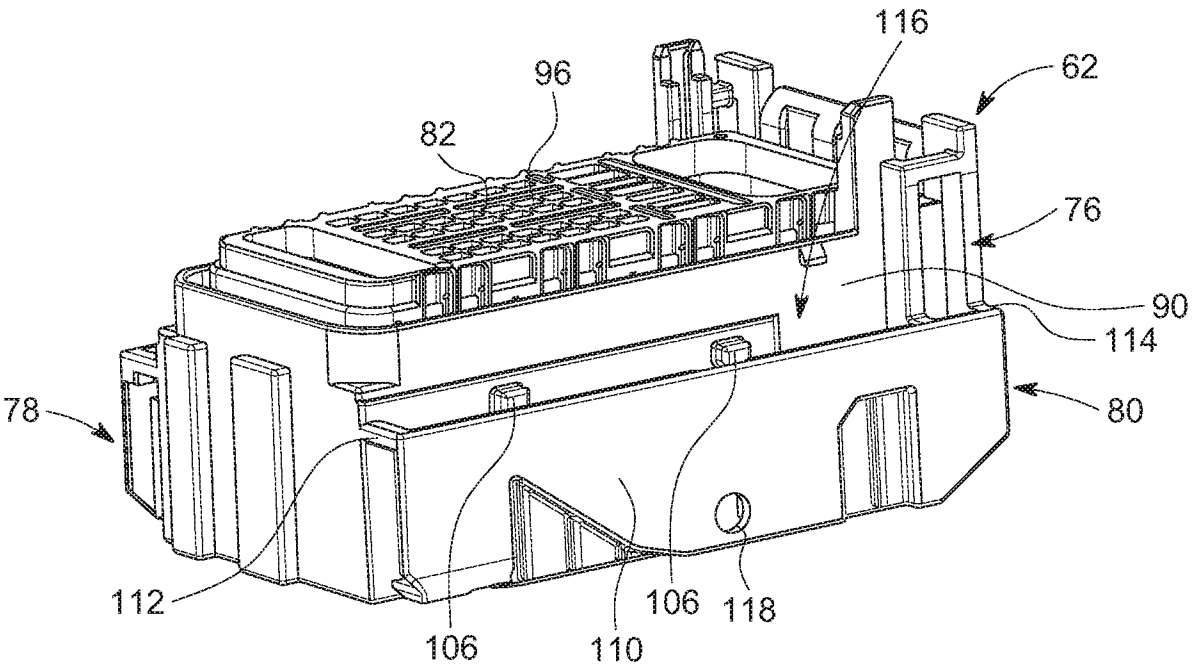
FIG. 10 depicts a front perspective view of an outer connector housing of an actuator connector of the lever-type electrical connector assembly, viewed from a top side thereof.
Figure 11:
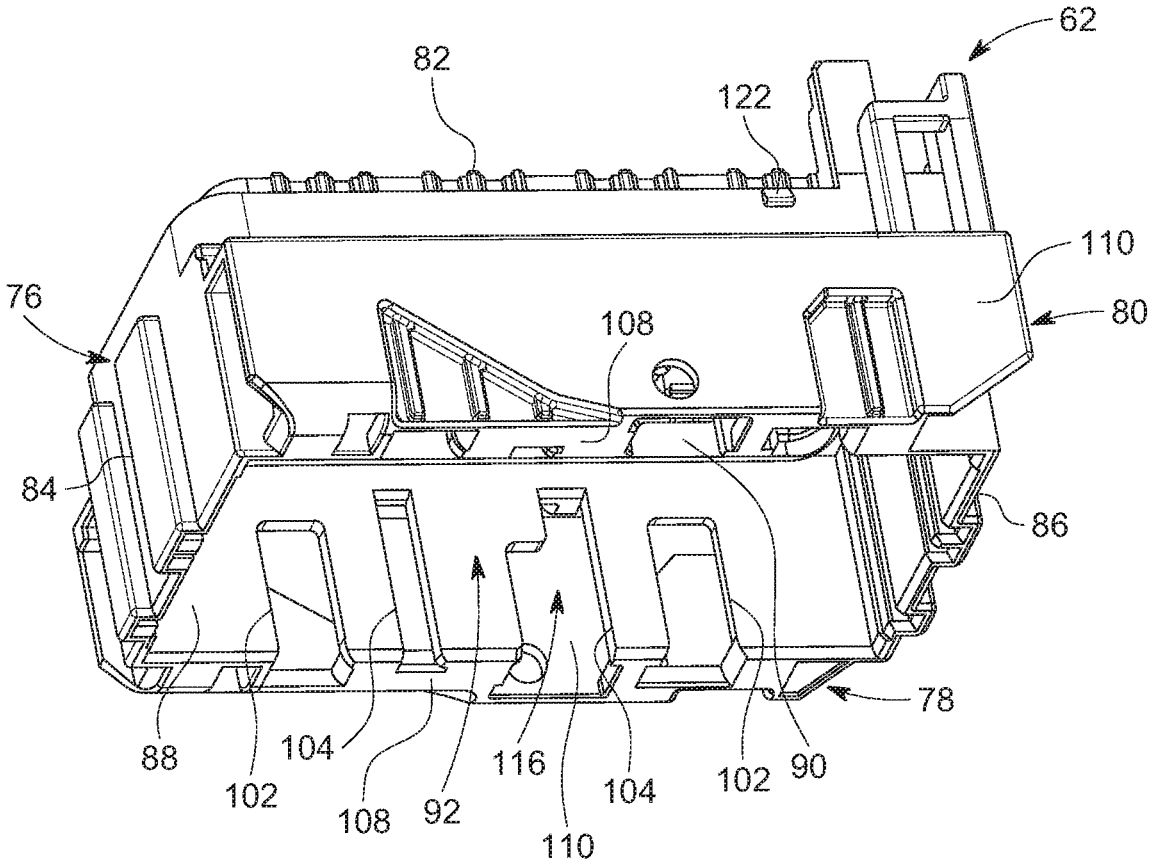
FIG. 11 depicts a front perspective view of the outer connector housing, viewed from a bottom side thereof.
Figure 12:
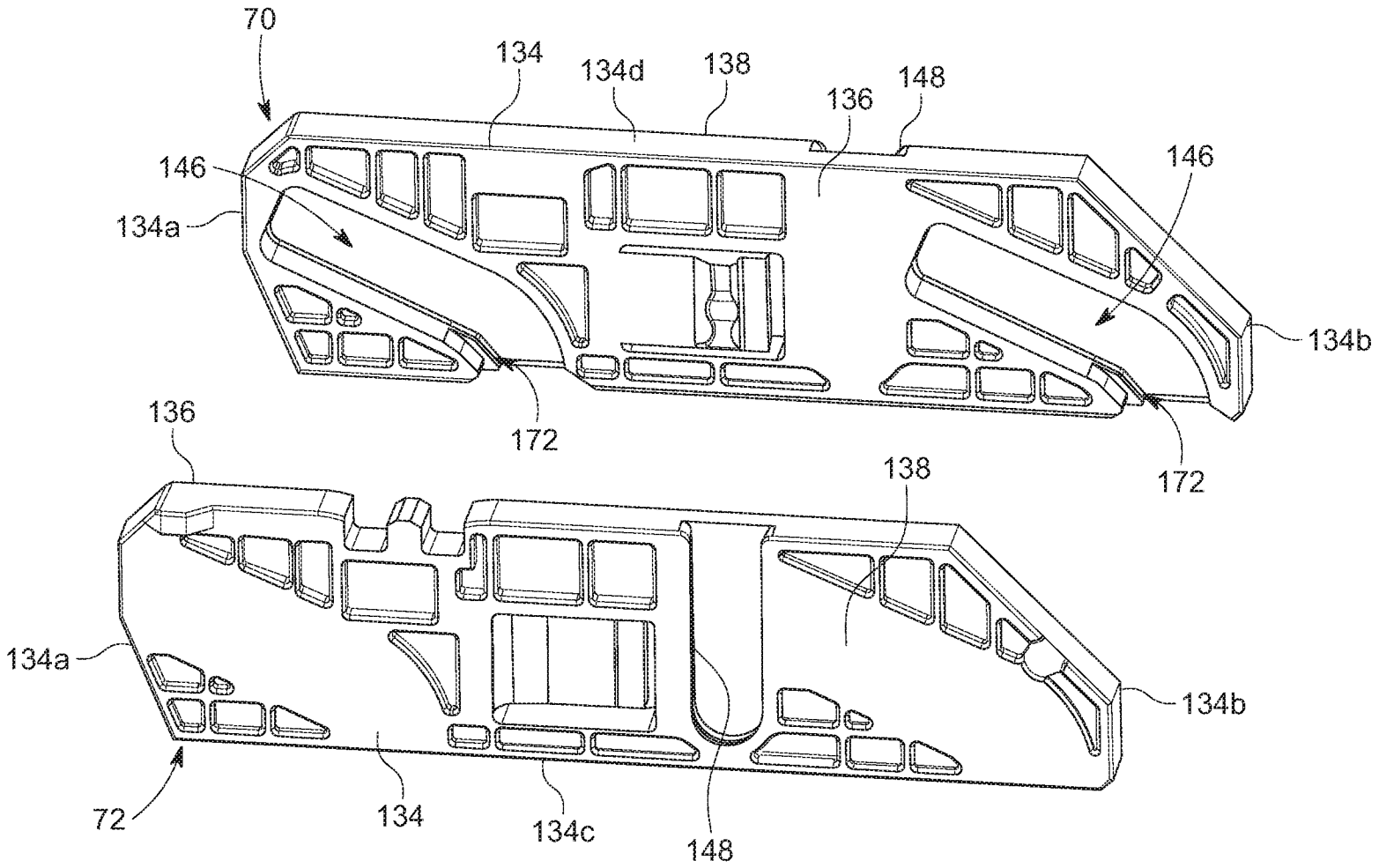
FIGS. 12 and 13 depict perspective views of slide members of the actuator connector of the lever-type electrical connector assembly.
Figure 13:
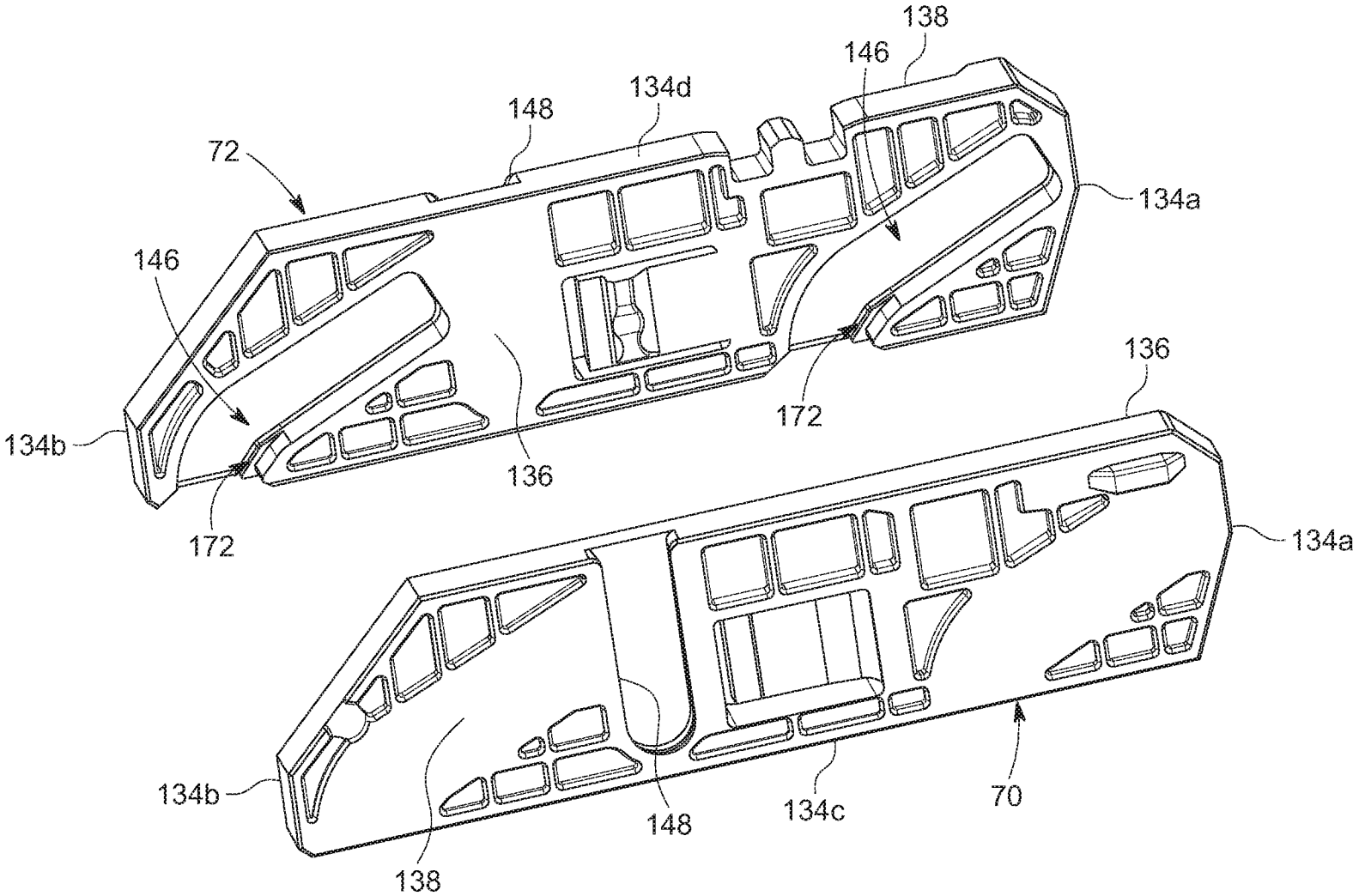
Figure 14:
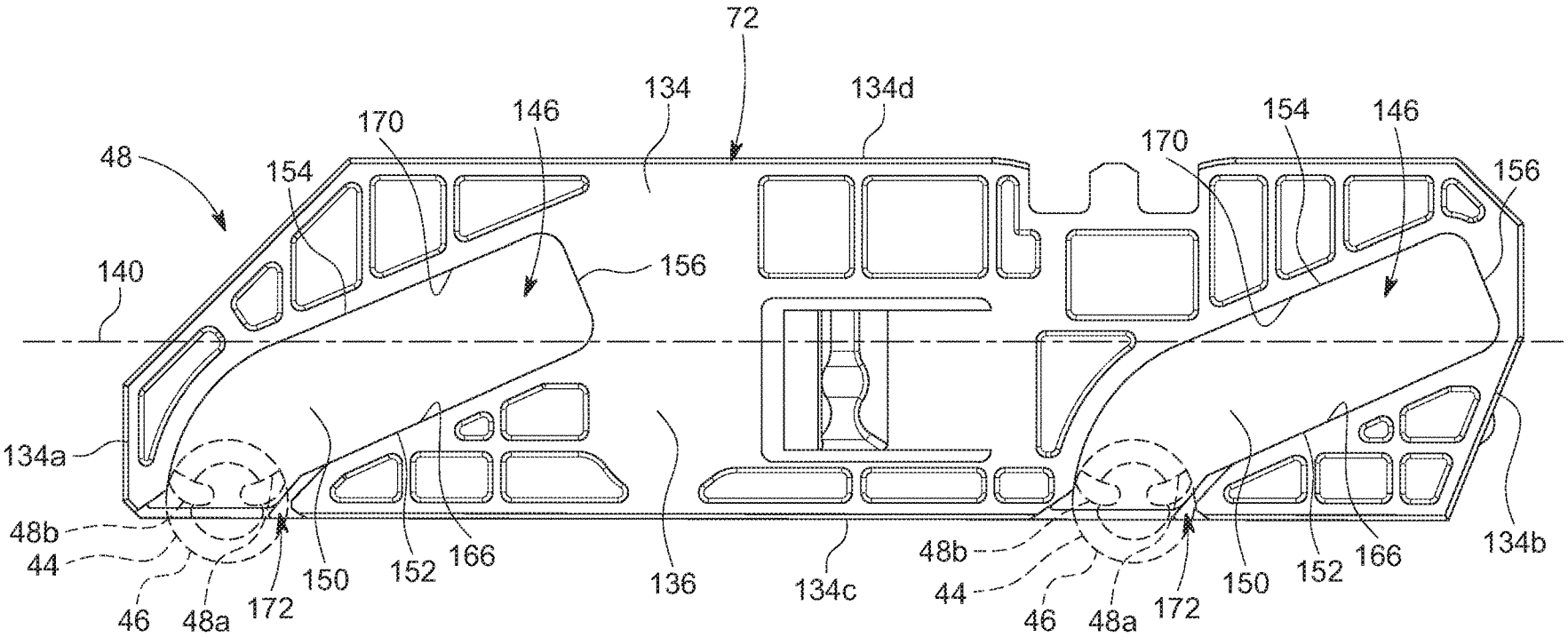
FIG. 14 depicts a side elevation view of one of the slide members, and showing a cam follower post of the mating connector in phantom line.
Figure 15:
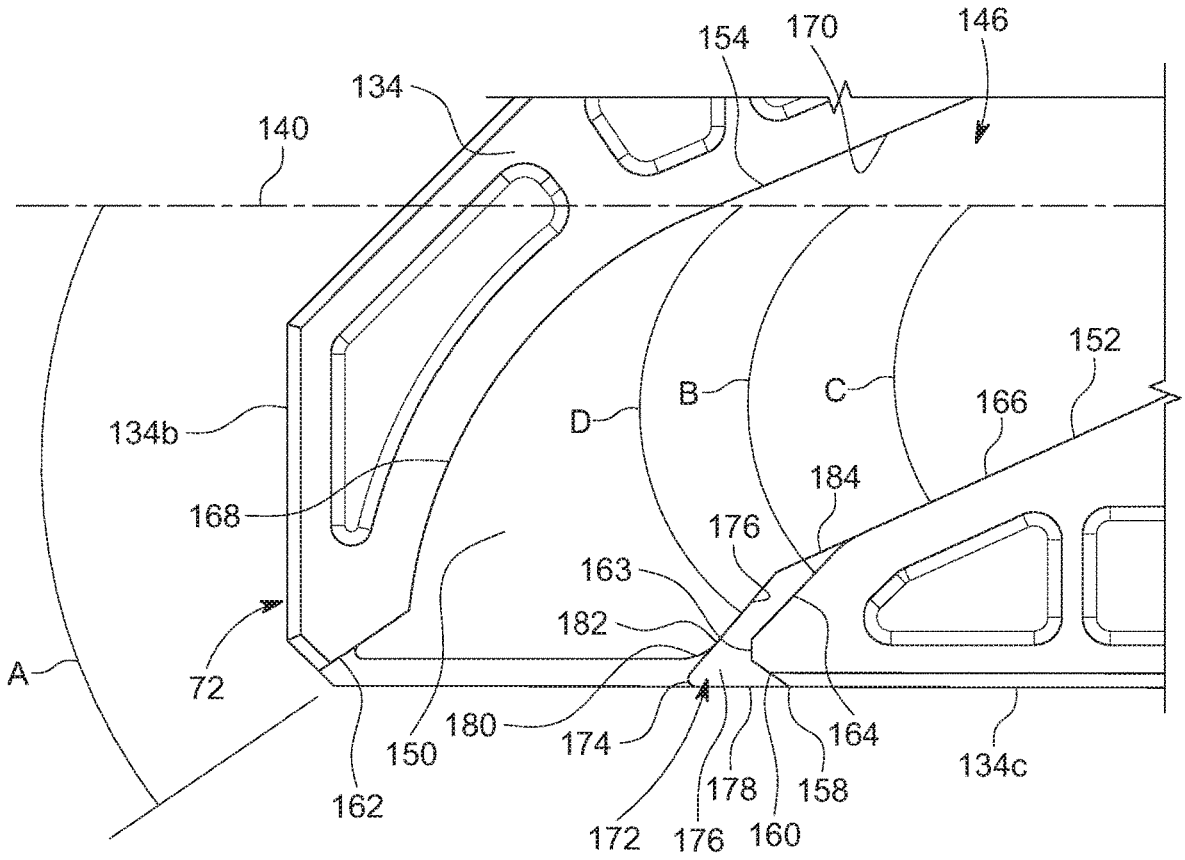
FIG. 15 depicts a partial side elevation view of one of the slide members.

As best shown in FIGS. 10 and 11, the connector housing 62 has a main body portion 76, a first retaining portion 78 extending outwardly from a first side of the main body portion 76, and a second retaining portion 80 extending outwardly from a second opposite side of the main body portion 76. The connector housing 62 is a unitary structure which may be molded of plastic material.

The main body portion 76 is generally rectangular and has a base wall 82 at a top end thereof having front, rear and side walls 84, 86, 88, 90 extending downward from the outer perimeter of the base wall 82, such that an open-bottomed cavity 92 is formed. A longitudinal axis 94 of the connector housing 62 extends parallel to the side walls 88, 90 from the front wall 84 to the rear wall 86.

Figure 16:
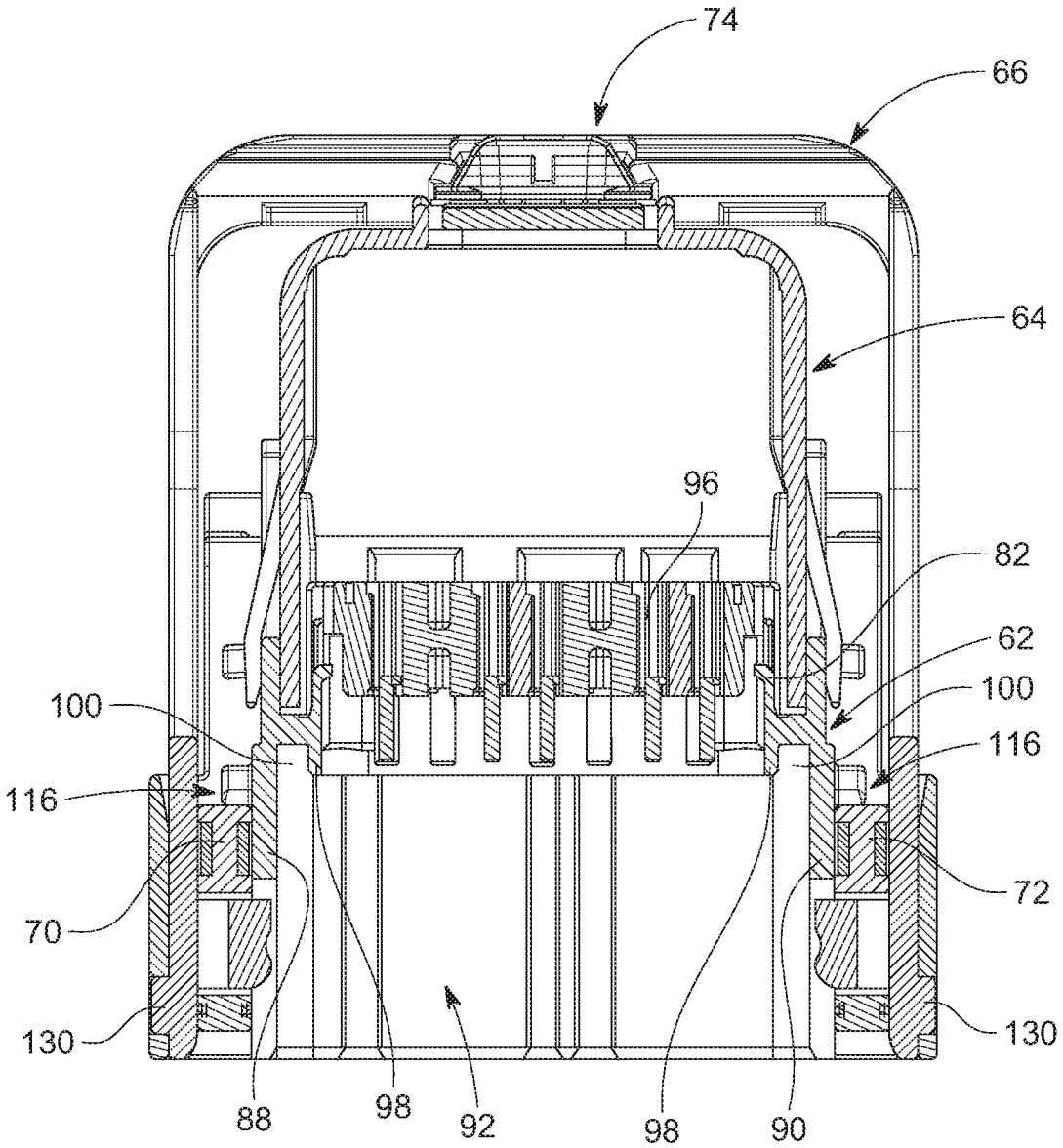
FIG. 16 depicts a cross-sectional of a portion of the actuator connector.
Figure 17:
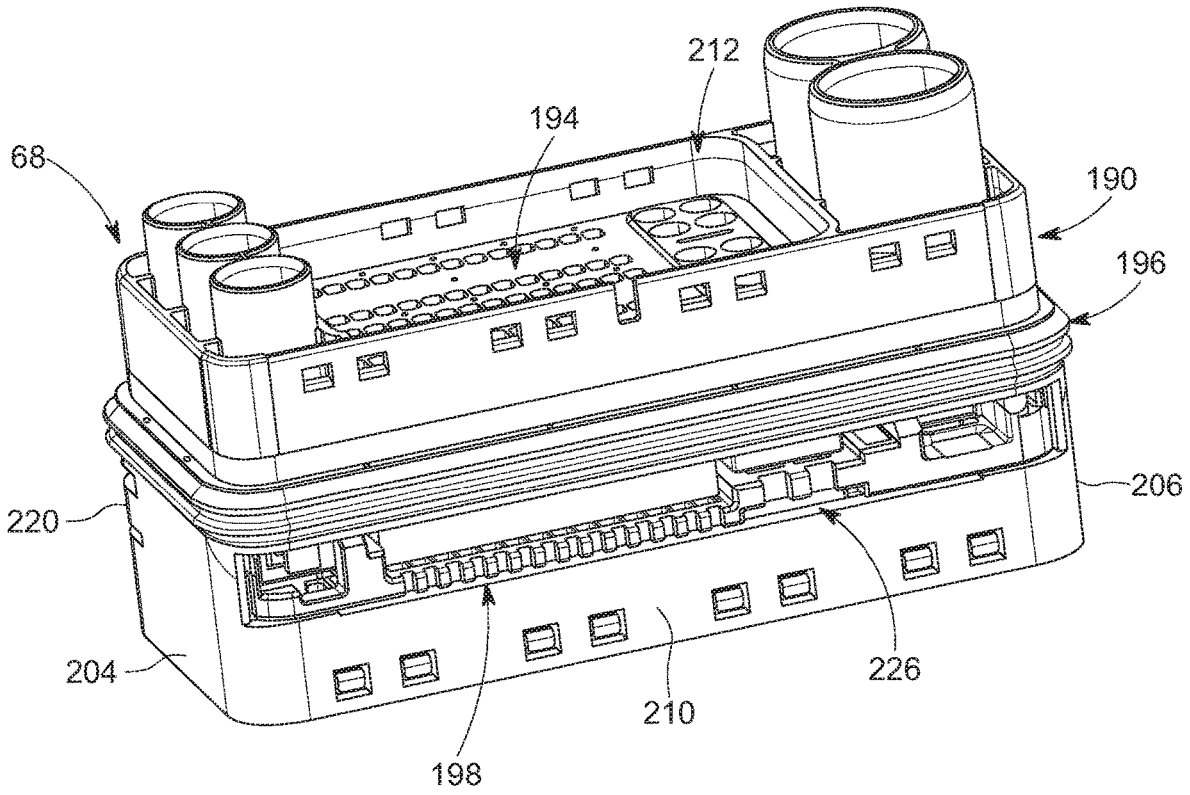
FIG. 17 depicts a front perspective view of a terminal retention portion of the actuator connector, viewed from a top side thereof.
Figure 18:
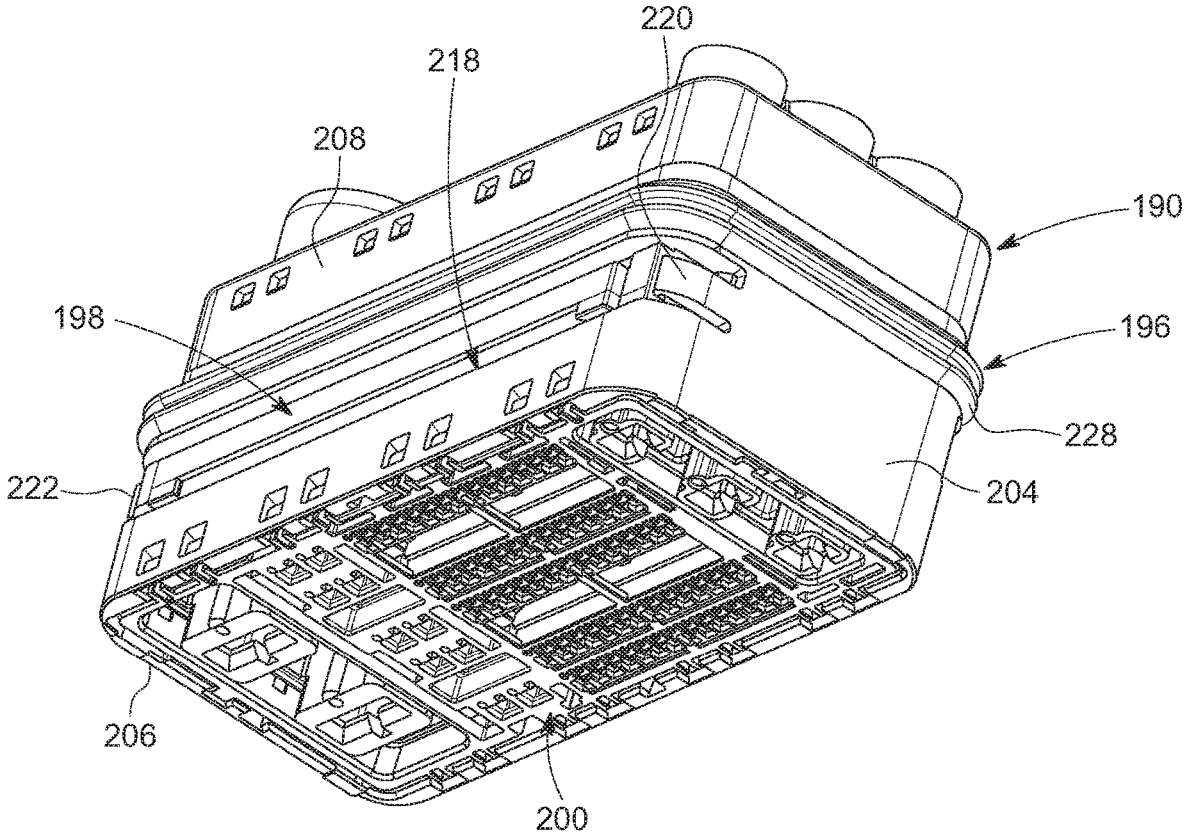
FIG. 18 depicts a rear perspective view of the terminal retention portion of the actuator connector, viewed from a bottom side thereof.

A plurality of passageways 96 through which terminals (not shown) pass are provided through the base wall 82 and extend perpendicular to the longitudinal axis 94. A rectangularly shaped retaining lip 98 extends downwardly from the base wall 82 and is spaced from the front, rear and side walls 84, 86, 88, 90 such that a space 100, see FIG. 16, is formed between the outside of the lip 98 and the walls 84, 86, 88, 90 and which is in communication with the cavity 92. The plug housing 26 of the mating connector 24 seats within the cavity 92 and the space 100 as described herein.

Each side wall 88, 90 has a pair of spaced apart vertically extending cam follower post receiving slots 102 extending upward from a bottom end thereof. The cam follower post receiving slots 102 receive the reinforcing ribs 42 therein from the mating connector 24 and the cam follower posts 44 project outwardly from each side wall 88, 90 as described herein. Each side wall 88, 90 further has a pair of vertically extending projection receiving slots 104 extending upward from the bottom end thereof. The projection receiving slots 104 are between the cam follower post receiving slots 102 and receive the reinforcing ribs 56 therein from the mating connector 24 and the projections 58 project outwardly from each side wall 88, 90 as described herein. The side walls 88, 90 are planar with the exception of slide members retaining projections 106 which extend outwardly therefrom. In an embodiment, the slide members retaining projections 106 extend outwardly from the side walls 88, 90 above the cam follower post receiving slots 102.

Each retaining portion 78, 80 has a bottom wall 108 which extends outwardly from the side walls 88, 90, a side wall 110 extending upward from the outer end of the bottom wall 108, and a pair of top walls 112, 114 at front and rear ends of the side wall 110 which connect the side wall 110 to the respective side wall 88, 90 of the main body portion 76. An open-topped pocket 116 is formed by each retaining portion 78, 80 and the side walls 88, 90 of the main body portion 76. A pivot hole 118 is provided through each side wall 110 at approximately the midpoint of each side wall 110. Slide member 70 and a portion of the lever 66 seat within the pocket 116 of the retaining portion 78, and slide member 72 and a portion of the lever 66 seat within the pocket 116 of the retaining portion 80 as described herein.

The wire dress cover 64, see FIG. 1, combines with the rear wall 86 of the connector housing 62 to provide an opening for ingress/egress of an electrical cable having conductors terminated to the terminals within the connector housing 62. A flexible latch arm 120 is formed on opposite sides of the wire dress cover 64 for latching into engagement with a pair of chamfered latch bosses 122 extending from the base wall 82 of the connector housing 62.

The lever 66 is pivotally mounted on the connector housing 62 and sandwiches the respective slide member 70, 72 between the lever 66 and the side walls 90 of the main body portion 76 of the connector housing 62. The lever 66 preferably is fabricated of molded plastic material. The lever 66 is rotatable in a pivotal operating stroke in the direction of arrow "C", FIGS. 2 and 5, to draw the mating connector 24 into mated condition with the actuator connector 22. As shown in FIG. 7, the lever 66 includes a pair of actuating or mating assist lever arms 124, 126 joined by a cross portion 128 which generally spans the width of the actuator connector 22. Each lever arm 124, 126 has a pivot boss 130 at its lower end which extends outwardly therefrom and which engages with the pivot hole 118 in the side wall 110. The pivot bosses 130 snap into the pivot holes 118 during assembly. The lever 66 is free to pivot relative to the connector housing 62 about the pivot bosses 130. Each lever arm 124, 126 further has a slide member engaging projection 132 spaced upwardly from the lower end and which extends inwardly therefrom. Each slide member engaging projection 132 engages with the respective slide member 70, 72 as described herein.

The connector position assurance device 74 is engageable with the cross portion 128 of the lever 66 to lock the lever 66 to the wire dress cover 64 when the actuator connector 22 is in its fully mated position with the mating connector 24 as shown in FIG. 6.

As best shown in FIGS. 12-15, each slide member 70, 72 is formed of a relatively thin plate 134 having an inner planar side surface 136 and an outer planar side surface 138 and having a longitudinal axis 140 extending from a front end 134*a* of the plate 134 to a rear end 134*b* of the plate 134. Front and rear spaced apart cam grooves 146 are provided in the inner side surface 136 of each slide member 70, 72, and a lever projection receiving groove 148 is provided in the outer side surface 138 of each slide member 70, 72.

Each cam groove 146 is formed by a base wall 150 which is parallel to the inner side surface 136 and is recessed therefrom, a front wall 152 extending perpendicularly outwardly from the base wall 150 to the inner side surface 136, and a rear wall 154 extending perpendicularly outwardly from the base wall 150 to the inner side surface 136. An end wall 156 is provided at the rear ends of the walls 150, 152, 154. An opening 158 is provided at the bottom ends of the front and rear walls 152, 154 in a bottom end 134*c* of the plate 134. The opening 158 is formed by front and rear walls 160, 162 which angle inwardly toward each other to form lead-in surfaces to the respective front and rear walls 152, 154. The rear wall 162 is angled relative to the angle A relative to the longitudinal axis 140.

Each front wall 152 has a first lower wall portion 163 which extends vertically upward from the front wall 160 of the opening 158, a second lower wall portion 164 which extends forwardly and upwardly at an angle B relative to the longitudinal axis 140 and extends from the upper end of the first lower wall portion 163, and an upper wall portion 166 which extends forwardly and upwardly from the upper forward end of the lower wall portion 164 and at an angle C relative to the longitudinal axis 140. The angle B is greater than the angle C.

Each rear wall 154 has a lower wall portion 168 which is curved along a radius line which is equal to the radius of the main body 46, which extends forwardly and upwardly, and which extends from the upper end of the rear wall 162 of the opening 158, and an upper wall portion 170 which extends forwardly and upwardly from the upper forward end of the lower wall portion 168 along a tangent line thereof. In each cam groove 146, the upper wall portion 170 of the rear wall 154 is parallel to the upper wall portion 166 of the front wall 152 and the space formed between the upper wall portions 166, 170 is approximately equal to the diameter of the main body 46. The rear wall 162 is rearward of the first lower wall portion 163. The lower wall portion 168 is rearward of the second lower wall portion 164 and the upper wall portion 166. In each cam groove 146, the space formed between the first lower wall portion 163 and the junction of the rear wall 162 and the lower wall portion 168 is approximately equal to the diameter of the main body 46.

In each cam groove 146, a blocking shoulder 172 extends rearwardly from the front wall 152, and outwardly from the base wall 150, such that a secondary opening 174 is formed in the bottom end 134*c* of the plate 134 between the bottom end of the blocking shoulder 172 and the rear wall 162. Each blocking shoulder 172 has a side wall 176 which extends rearwardly from the front wall 160 and the wall portions 163, 164 and is parallel to the base wall 150 and the inner side surface 136, a bottom wall 178 which extends from the bottom end 134*c* of the plate 134 and is planar, and a rear wall 180 which extends outwardly from the base wall 150 to the side wall 176. The side wall 176 is spaced from the base wall 150 at a distance which is equal to the distance the crescent shaped projections 48*a* project outwardly from the main body 46 of the respective cam follower post 44. The rear wall 180 has a lower wall portion 182 which extends forwardly and upwardly from the bottom end 134*c* of the plate 134 at an angle C relative to the longitudinal axis 140, and an upper wall portion 184 which extends forwardly and upwardly from the upper forward end of the lower wall portion 182 and at the angle C. The forward end of the upper wall portion 184 merges with the upper wall portion 166. The angle D is greater than angles A and B. In each cam groove 146, the space formed between the lower wall portion 182 and the lower wall portion 168 is approximately equal to the diameter of the main body 46.

The lever projection receiving groove 148 in the outer side surface 138 of each slide member 70, 72 extends vertically downward from a top surface 134*d* of the plate 134. The lever projection receiving groove 148 is longitudinally rearward of the front cam groove 146 and is longitudinally forward of the rear cam groove 146.

Figure 2:
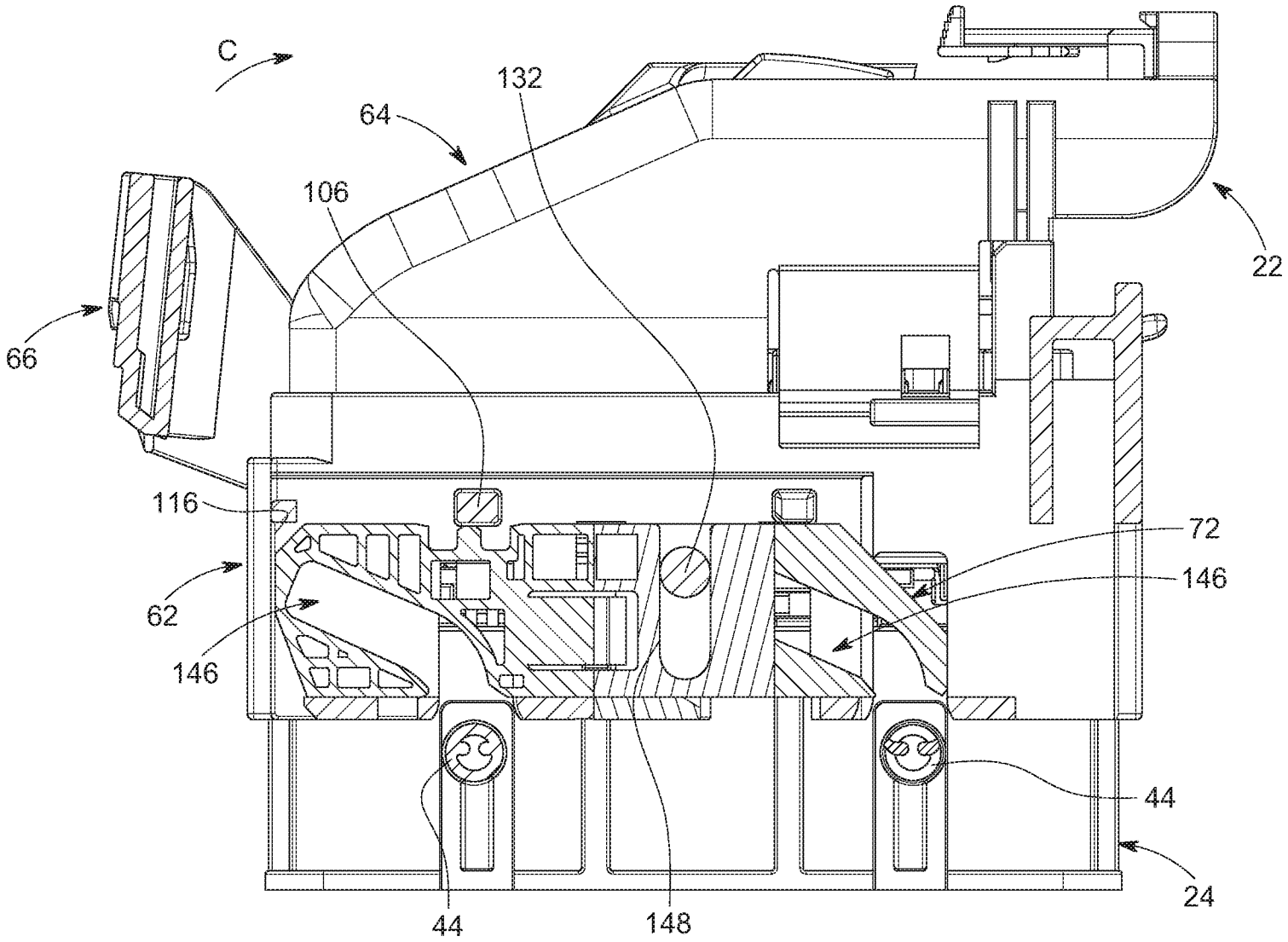
FIG. 2 depicts a stepped cross-sectional view of the lever-type electrical connector assembly in a partially assembled condition.
Figure 2A:
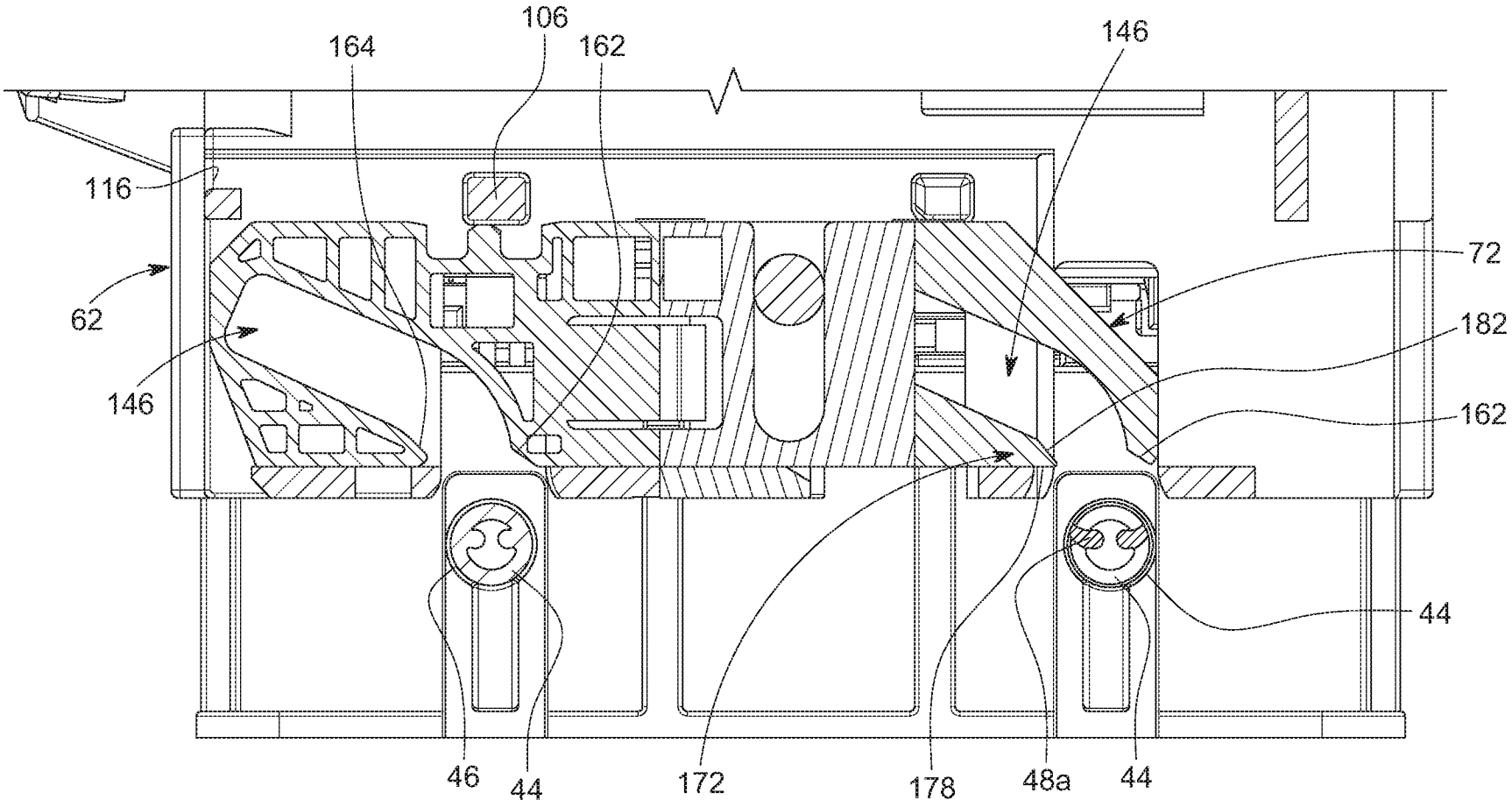
FIG. 2A depicts an enlarged partial stepped cross-sectional view of the lever-type electrical connector assembly in the partially assembled condition of FIG. 2.

As shown for example in in FIG. 2, when the slide members 70, 72 are assembled with the connector housing 62, the slide members 70, 72 seat within the respective pockets 116 with the top surfaces 136*d* underneath the slide members retaining projections 106, the inner side surfaces 136 of the slide members 70, 72 engage against the respective side walls 88, 90 of the connector housing 62, and the outer side surfaces 138 of the slide member 70, 72 face the side wall 110 of the respective retaining portion 78, 80 of the connector housing 62, but are spaced therefrom. The arm 124 of the lever 66 seats within the pocket 116 of the retaining portion 78, between the outer side surface 138 of the slide member 70 and the side wall 110, with the slide member engaging projection 132 engaged within the lever projection receiving groove 148 of the slide member 70 and the pivot boss 130 on the arm 124 engaged within the pivot hole 118 of the side wall 110 of the retaining portion 78. The arm 126 of the lever 66 seats within the pocket 116 of the retaining portion 80, between the outer side surface 138 of the slide member 72 and the side wall 110, with the slide member engaging projection 132 engaged within the lever projection receiving groove 148 of the slide member 72 and the pivot boss 130 on the arm 126 engaged within the pivot hole 118 of the side wall 110 of the retaining portion 80.

The terminal retention portion 68 seats within the cavity 92 of the main body portion 76 as described herein.

Figure 4:
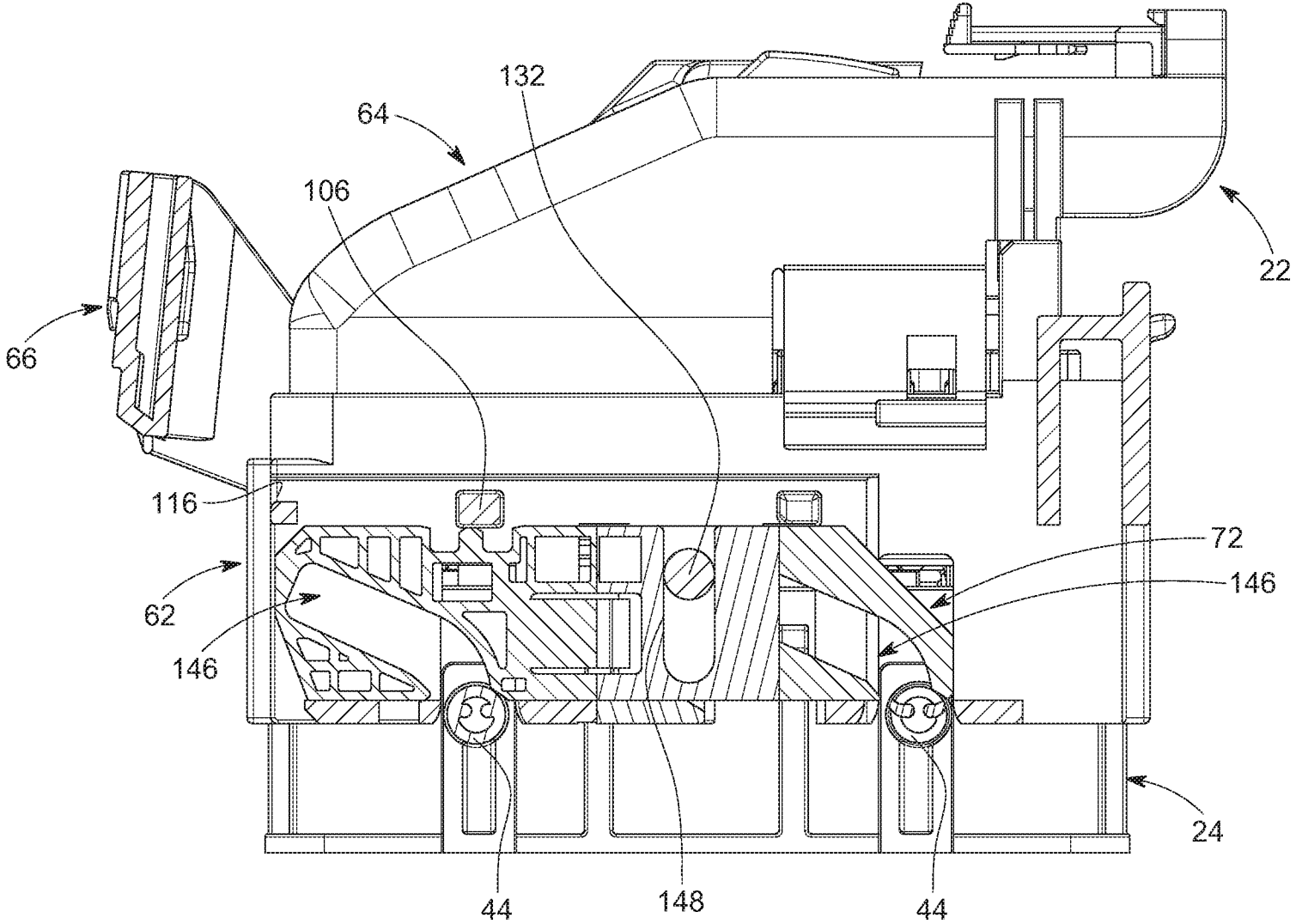
FIG. 4 depicts a stepped cross-sectional view of the lever-type electrical connector assembly in the ready-to mate position of FIG. 3.
Figure 4A:
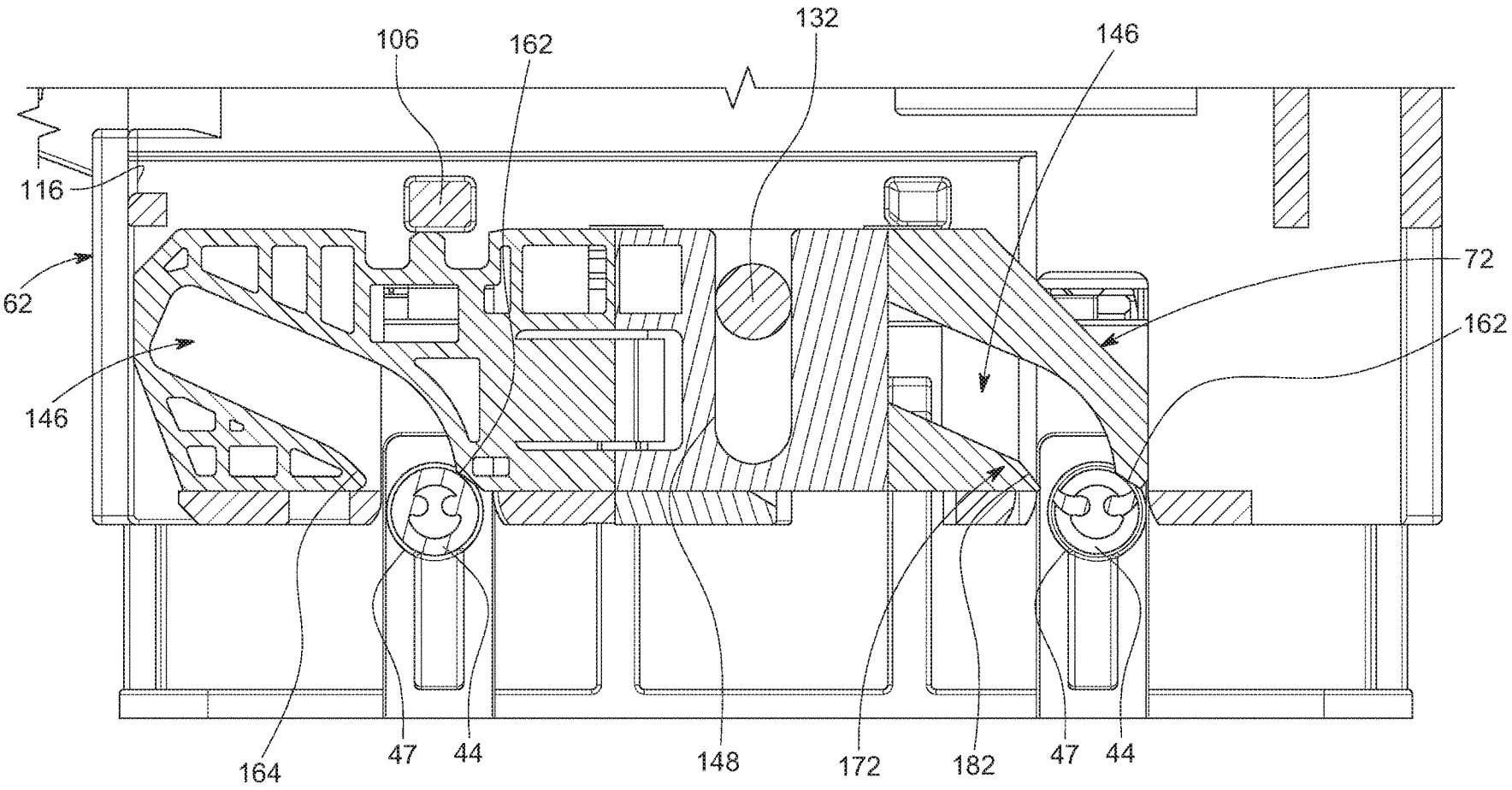
FIG. 4A depicts an enlarged partial stepped cross-sectional view of the lever-type electrical connector assembly in the ready-to mate position of FIGS. 3 and 4.
Figure 5:
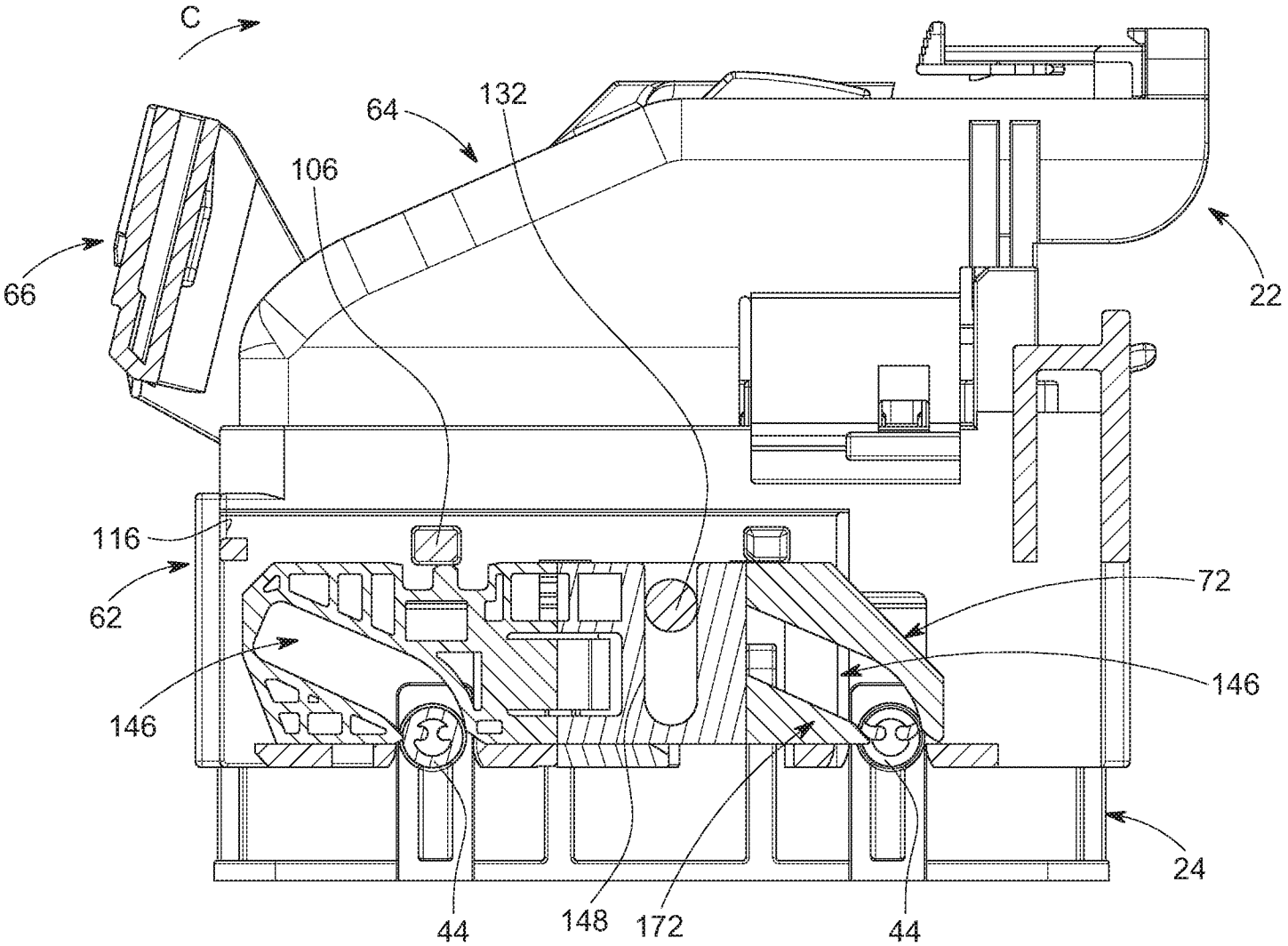
FIG. 5 depicts a stepped cross-sectional view of the lever-type electrical connector assembly in a further partially assembled condition from that shown in FIGS. 3-4A.

FIGS. 1, 2, 3, 5 and 6 show various positions of the lever 66 for reference purposes in the following detailed description. FIG. 1 shows the lever 66 in its unmated or preliminary position. FIG. 3 shows the lever 66 in an intermediate, ready to mate position. FIG. 5 shows the lever 66 in a partially mated position. FIG. 6 shows the lever 66 in its fully mated position. FIGS. 2, 2A, 4, 4A5 and 5A show stepped cross-sections such that the front cam follower post 44 (shown to the left in these figures) is shown at a different cross-section than the rear cam follower post 44 (shown to the right in these figures) to illustrate the interaction of the cam follower posts 44 with the slide member 72.

To assemble the lever-type electrical connector assembly 20, the actuator connector 22 is moved in the direction shown by arrow "M" as shown in FIG. 1 to engage with the mating connector 24. The lever 66 is in the position shown in FIG. 1 such that the cross portion 128 is proximate to the front wall 84 of the connector housing 62. The plug housing 26 of the mating connector 24 passed through the open bottom of the main body portion 76 and into the cavity 92.

The reinforcing ribs 42 slide into the cam follower post receiving slots 102, and the reinforcing ribs 56 slide into the projection receiving slots 104. The cam follower posts 44 and the projections 58 extend outwardly from the side walls 88, 90 and into the pockets 116 of the respective retaining portions 78, 80. This initially connects the mating connector 24 and the actuator connector 22 together. The projections 58 engage with the inner side surfaces 136 of the respective slide member 70, 72, and the cam follower posts 44 on the opposite side walls 34, 36 engage with the bottom ends 134*c* of the plates 134 of each slide member 70, 72.

To enter into the cam grooves 146, the perimeter surfaces 47 of the main bodies 46 of the cam follower posts 44 must first engage with the rear walls 162 of the slide members 70, 72 as shown in FIGS. 4 and 4A. Prior to this position as shown in FIG. 2, the lever 66 is in a first position.

FIGS. 4 and 4A shows the position of the perimeter surfaces 47 of the main bodies 46 engaged with the rear walls 162 of the slide members 70. In this position, the main bodies 46 of the cam follower posts 44 are spaced from the blocking shoulders 172. When the perimeter surfaces 47 of the main bodies 46 come into engagement with the rear walls 162, the lever 66 rotates in the direction shown by arrow "C", to provide a visual and tactile indication to the operator that the mating connector 24 is in the ready-to-mate position. The lever 66 rotates around slide member engaging projections 132, with movement of the slide member engaging projections 132 in the vertical lever projection receiving grooves 148. This indicates to the operator that the lever 66 can be advanced to the final fully mated position shown in FIG. 6.

If the plug housing 26 is inserted such that the main bodies 46 of the cam follower posts 44 are offset rearwardly from the rear walls 162, the crescent shaped projections 48*a* engage with the blocking shoulders 172. The convex surfaces 52 of the crescent shaped projections 48*a* may engage with the bottom walls 178 of the blocking shoulders 172 and the outer surfaces 49 of the main bodies 46 engage against the side walls 176 of the blocking shoulders 172, or the curved points 50 of the crescent shaped projections 48*a* may engage the junction between the bottom wall 178 and the lower wall portion 182 of the respective blocking shoulder 172. In this position, the cam follower posts 44 are blocked by the blocking shoulders 172 from entering into the cam grooves 146; the cam follower posts 44 can only enter into the cam grooves 146 when the cam follower posts 44 are in the correct position. To remove the block formed by the blocking shoulders 172, the lever 66 is rotated in the direction of arrow "C" such that the lever 66 is rotated toward the rear wall 86 of the connector housing 62. When the lever 66 is so rotated, the slide members 70, 72 are moved longitudinally since the slide member engaging projections 132 pivot within the lever projection receiving groove 148 of the slide member 70 and bear against the rear wall of the lever projection receiving groove 148. As the crescent shaped projections 48*a* clear the engagement with the blocking shoulders 172, the lever 66 rotates in a direction opposite to direction shown by arrow "C" to provide a visual indication to the user that the crescent shaped projections 48*a* have cleared the engagement with the blocking shoulders 172, and that the mating connector 24 is in the ready-to-mate position. This causes the perimeter surfaces 47 of the main bodies 46 of the cam follower posts 44 to engage with the rear walls 162.

Figure 5A:
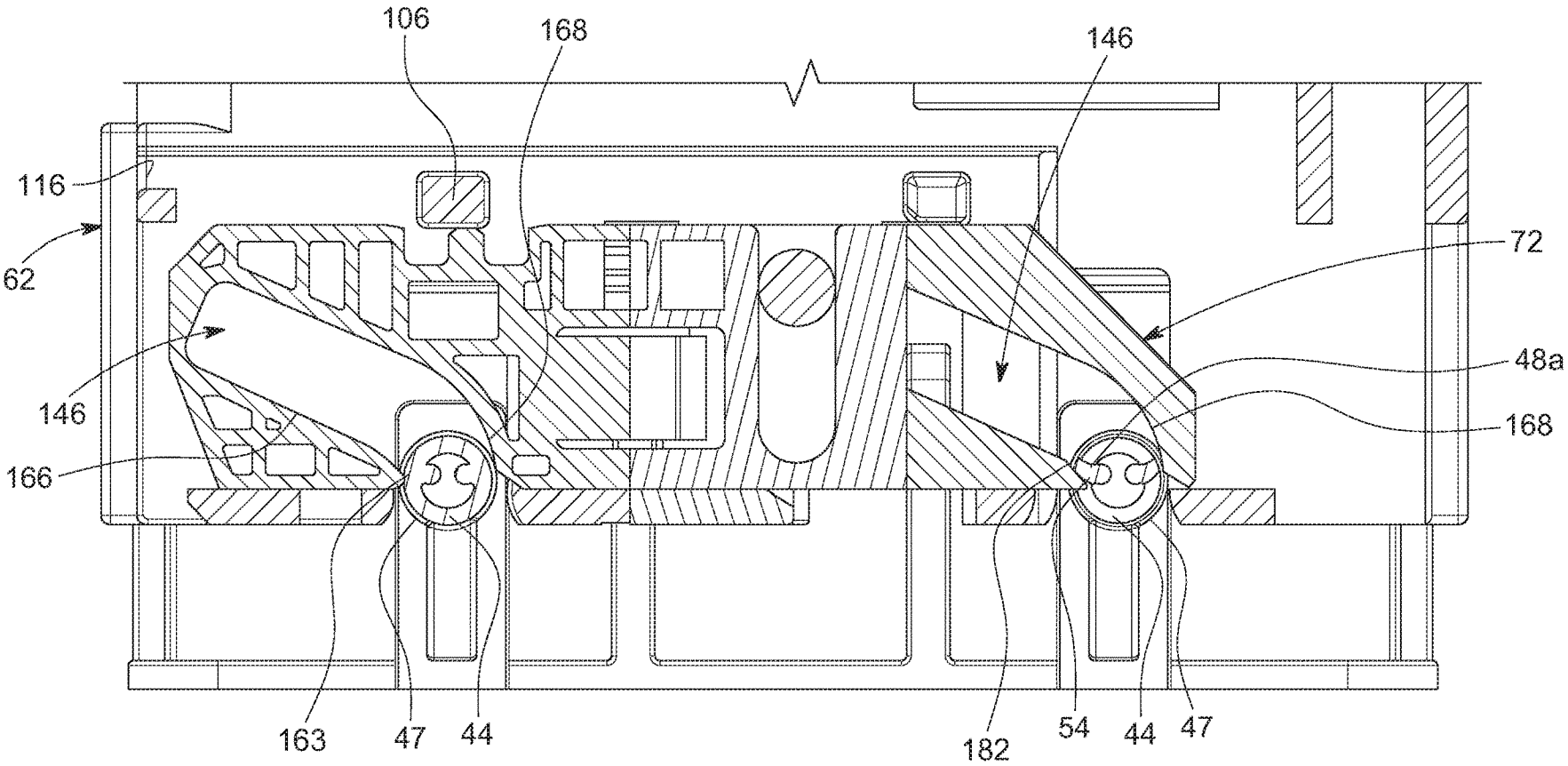
FIG. 5A depicts an enlarged partial stepped cross-sectional view of the lever-type electrical connector assembly in the further partially assembled condition of FIG. 5.

After the position of FIGS. 4 and 4A is achieved, the lever 66 is rotated in the direction of arrows "C" such that the cross portion 128 is moved from proximate to the front wall 84 of the connector housing 62 to proximate to the rear wall 86 of the connector housing 62 as shown in FIGS. 5 and 6. When the lever 66 is rotated, this causes the cam follower posts 44 to travel along the cam grooves 146 and causes the slide member engaging projections 132 to travel vertically along the lever projection receiving grooves 148. The crescent shaped projections 48*a* pass through the secondary openings 174 and the main bodies 46 pass through the openings 158. The concave surfaces 54 of the crescent shaped projections 48*a* engage with the lower wall portions 182, as shown in FIGS. 5 and 5A, and slide along the angled lower wall portions 182. The outer surfaces 49 of the main bodies 46 may engage against, and slide over, the side walls 176. As the lever 66 is further rotated, the perimeter surfaces 47 of the main bodies 46 of the cam follower posts 44 engage with the curved lower wall portions 168. As the lever 66 is further rotated, the perimeter surfaces 47 of the main bodies 46 and the curved points 50 of the cam follower posts 44 engage with, and travel along, the upper wall portions 166, 170. As a result, the slide members 70, 72 move longitudinally rearward as the lever 66 rotates. The wall portions 168, 166, 170 form camming surfaces for the cam follower posts 44 to engage and travel along.

The lever 66 is locked to the wire dress cover 64 using the connector position assurance device 74 in its fully mated position with the mating connector 24 as shown in FIG. 6. When the actuator connector 22 is fully mated with the mating connector 24, the cam follower posts 44 are proximate to the end walls 156 of the cam grooves 146 and the slide member engaging projections 132 are proximate to a lower end of the lever projection receiving grooves 148.

Figure 26:
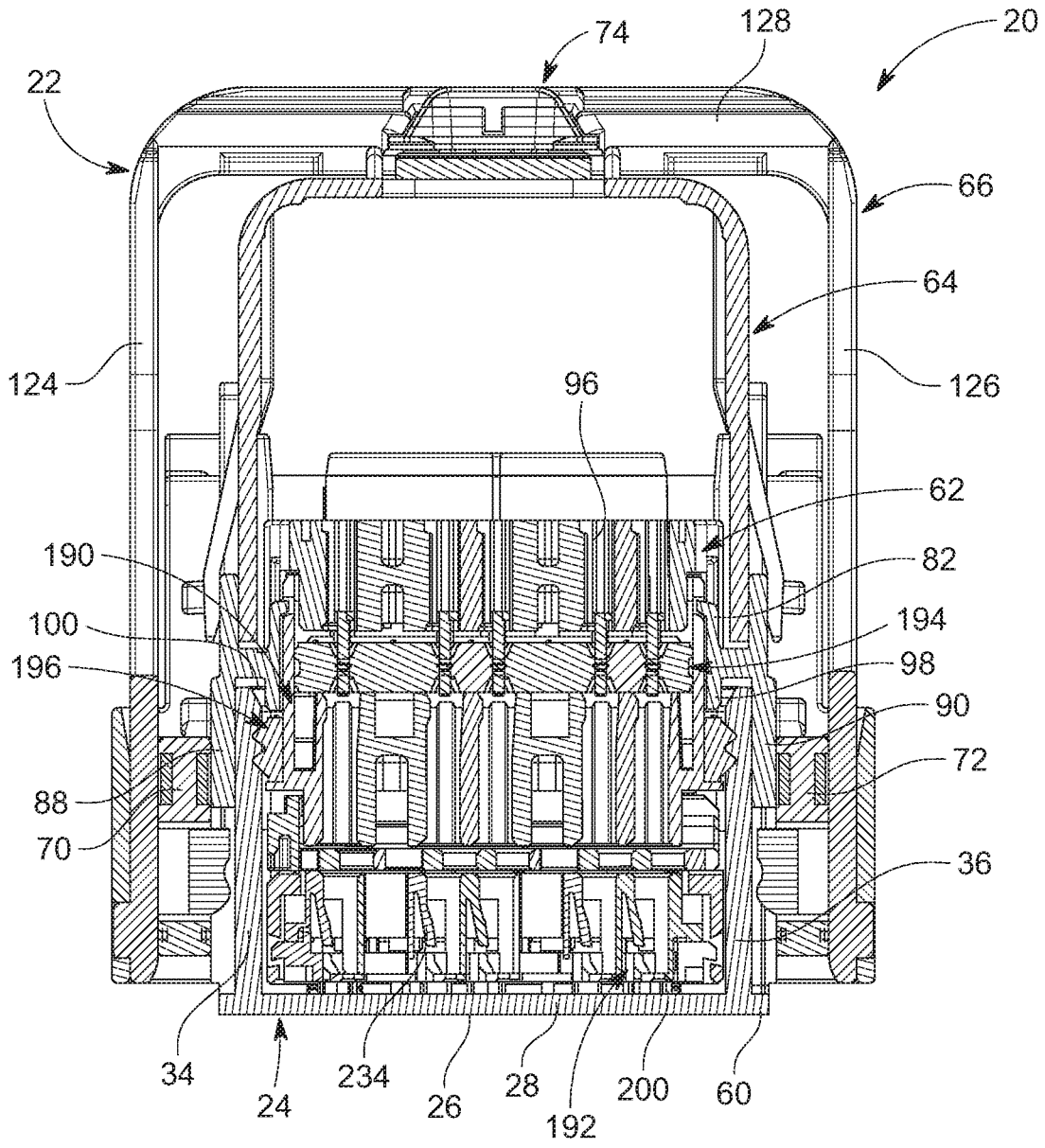
FIG. 26 depicts a cross-sectional of the lever-type electrical connector assembly.

When the actuator connector 22 is in its fully mated position with the mating connector 24, the upper ends of the walls 30, 32, 34, 36 of the plug housing 26 seat within the space 100 of the main body portion 76 as shown in FIG. 26. The lip 60 engages the bottom ends of the walls 84, 86, 88, 90 of the main body portion 76.

The mating connector 24 can be decoupled from the actuator connector 22 by rotating the lever 66 in a direction opposite to the direction shown by arrow "C" after the connector position assurance device 74 is decoupled from the lever 66 and the wire dress cover 64. When the lever 66 is rotated in the direction opposite to the direction shown by arrow "C" such that the cross portion 128 is moved from proximate to the rear wall 86 of the connector housing 62 to proximate to the front wall 84 of the connector housing 62. When the lever 66 is rotated, this causes the cam follower posts 44 to travel along the cam grooves 146 and causes the slide member engaging projections 132 to travel vertically along the lever projection receiving grooves 148. The perimeter surfaces 47 of the main bodies 46 and the curved points 50 of the cam follower posts 44 engage with, and travel along, the upper wall portions 166, 170. As the lever 66 is further rotated, the perimeter surfaces 47 of the main bodies 46 of the cam follower posts 44 engage with the curved lower wall portions 168. The outer surfaces 49 of the main bodies 46 may engage against, and slide over, the side walls 176. The concave surfaces 54 of the crescent shaped projections 48*a* engage with the lower wall portions 182, and slide along the angled lower wall portions 182. The crescent shaped projections 48*a* then pass through the secondary openings 174 and the main bodies 46 pass through the openings 158. As a result, the slide members 70, 72 move longitudinally forward as the lever 66 rotates.

As shown in FIGS. 17-25, the terminal retention portion 68 includes a terminal housing which includes an upper terminal housing 190 and a lower terminal housing 192, a mat seal 194, a perimeter seal 196, an independent secondary lock 198, and a lower cover 200. The upper terminal housing 190, the lower terminal housing 192, the independent secondary lock 198, and the lower cover 200 are formed of an insulative and may be molded from plastic. The mat seal 194 and the perimeter seal 196 are formed of an elastomeric material.

Figure 21:
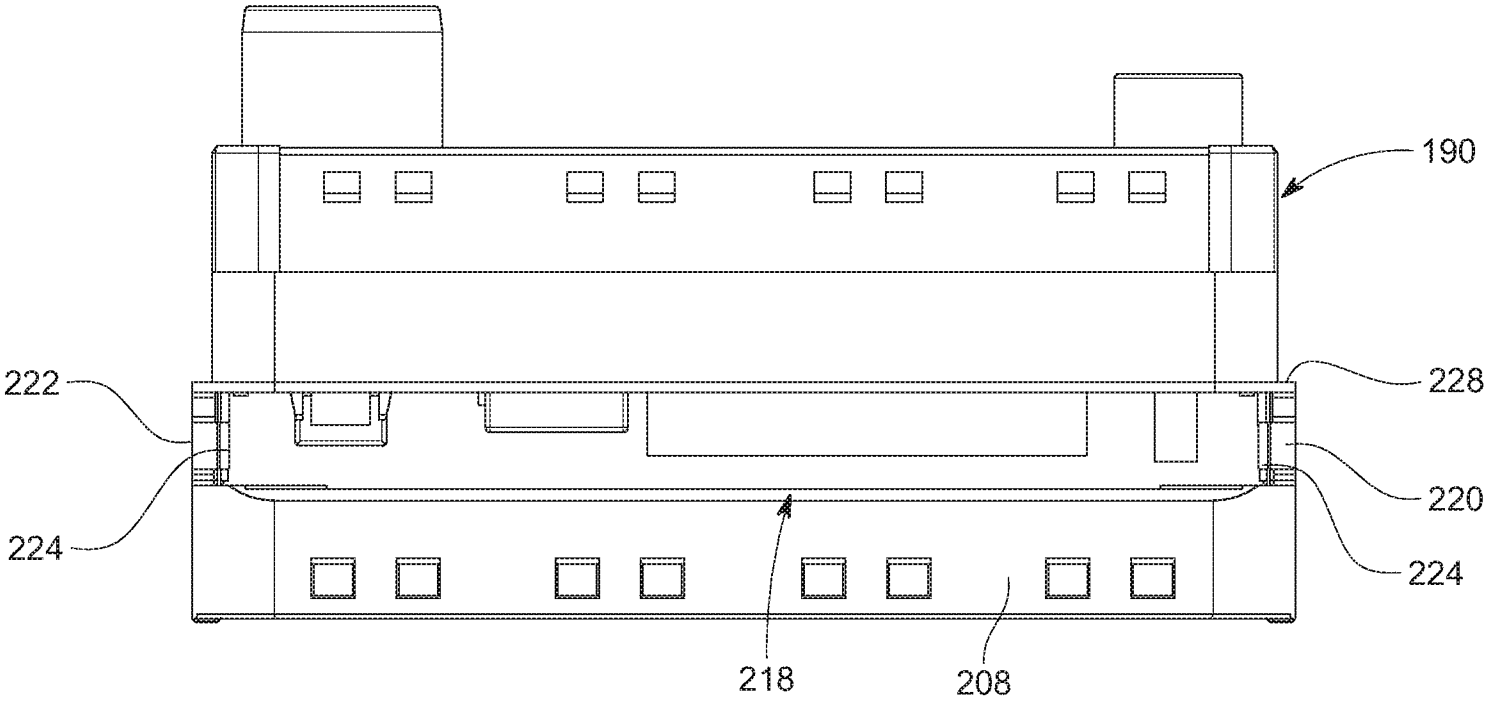
FIG. 21 depicts a side elevation of an upper terminal housing of the actuator connector.
Figure 22:
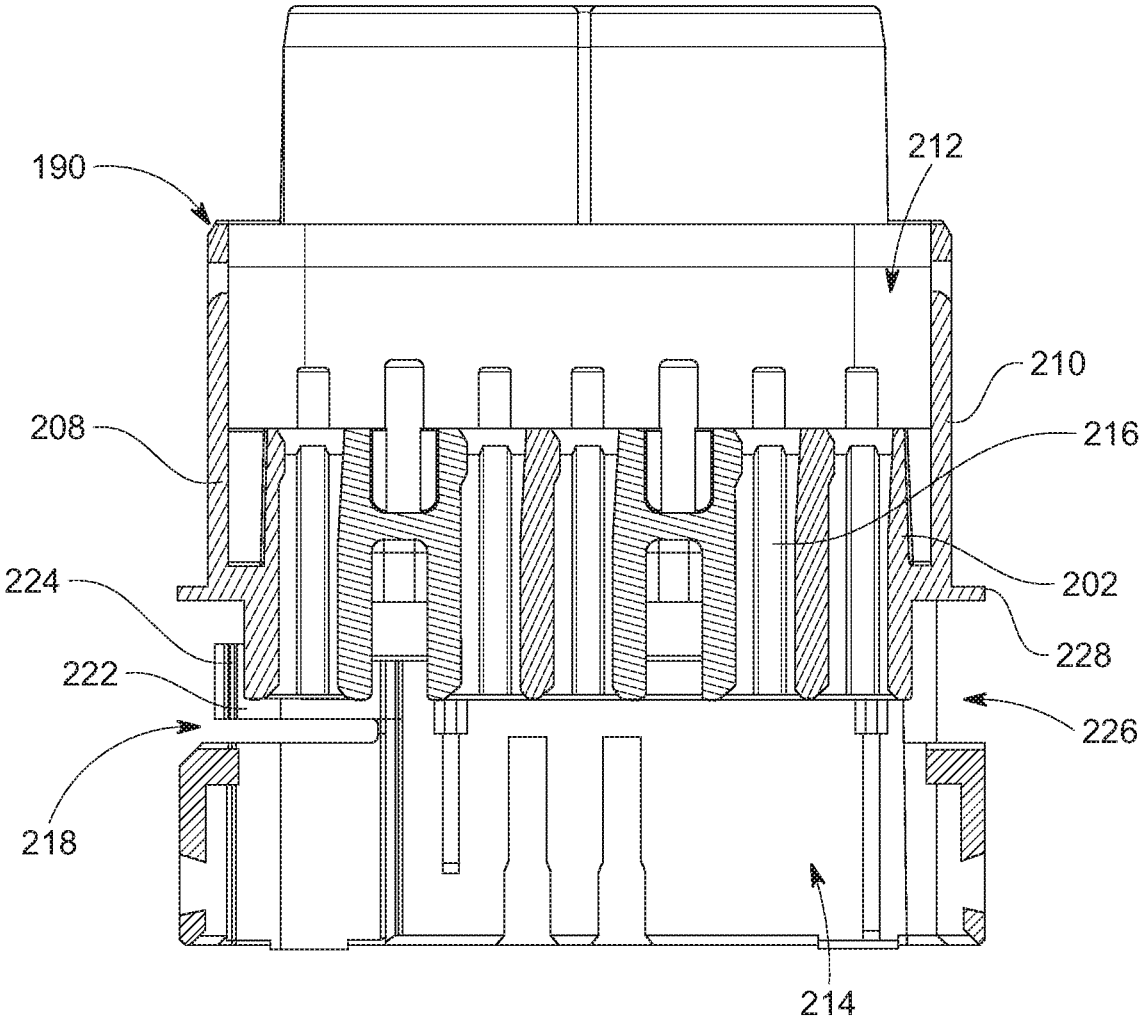
FIG. 22 depicts a cross-sectional of the upper terminal housing.
Figure 23:
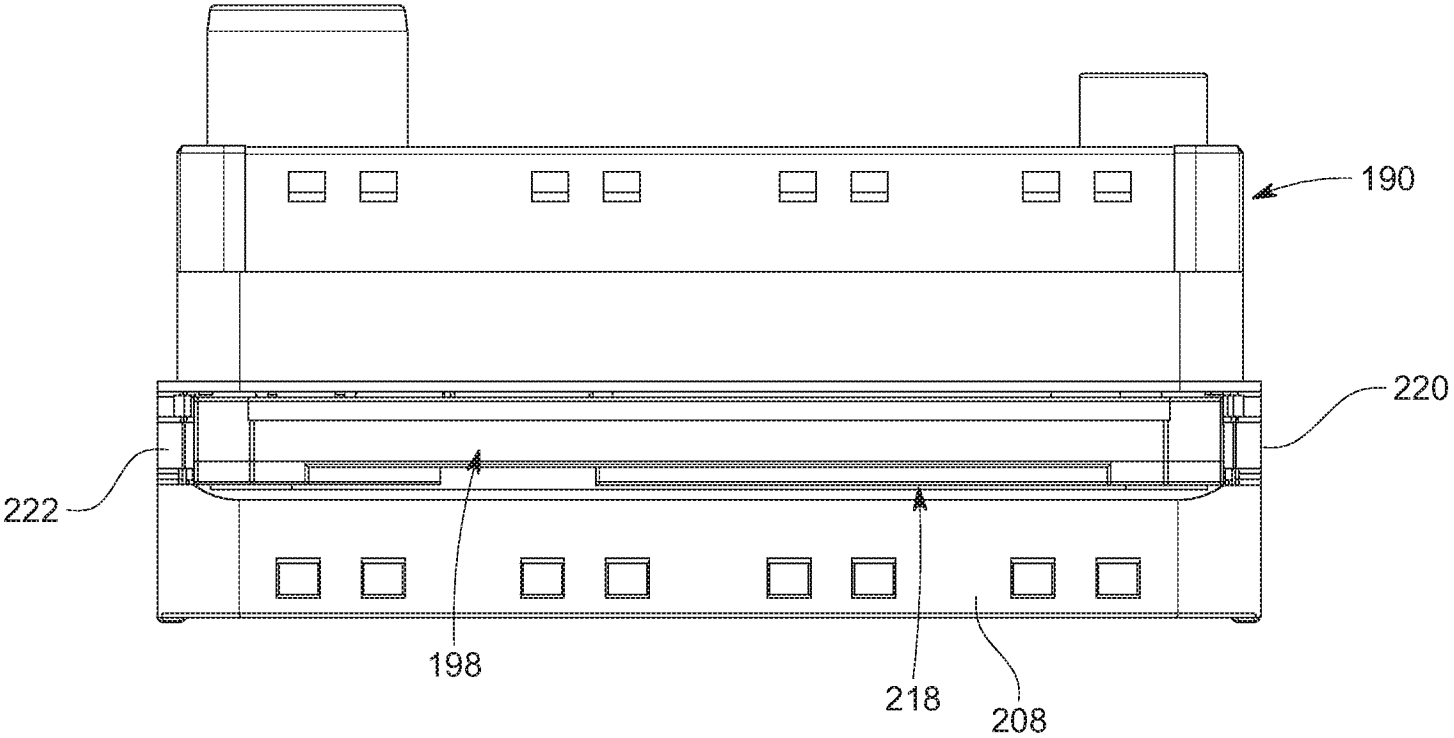
FIG. 23 depicts a side elevation of the upper terminal housing, having an independent secondary lock of the actuator connector mounted therein.
Figure 24:
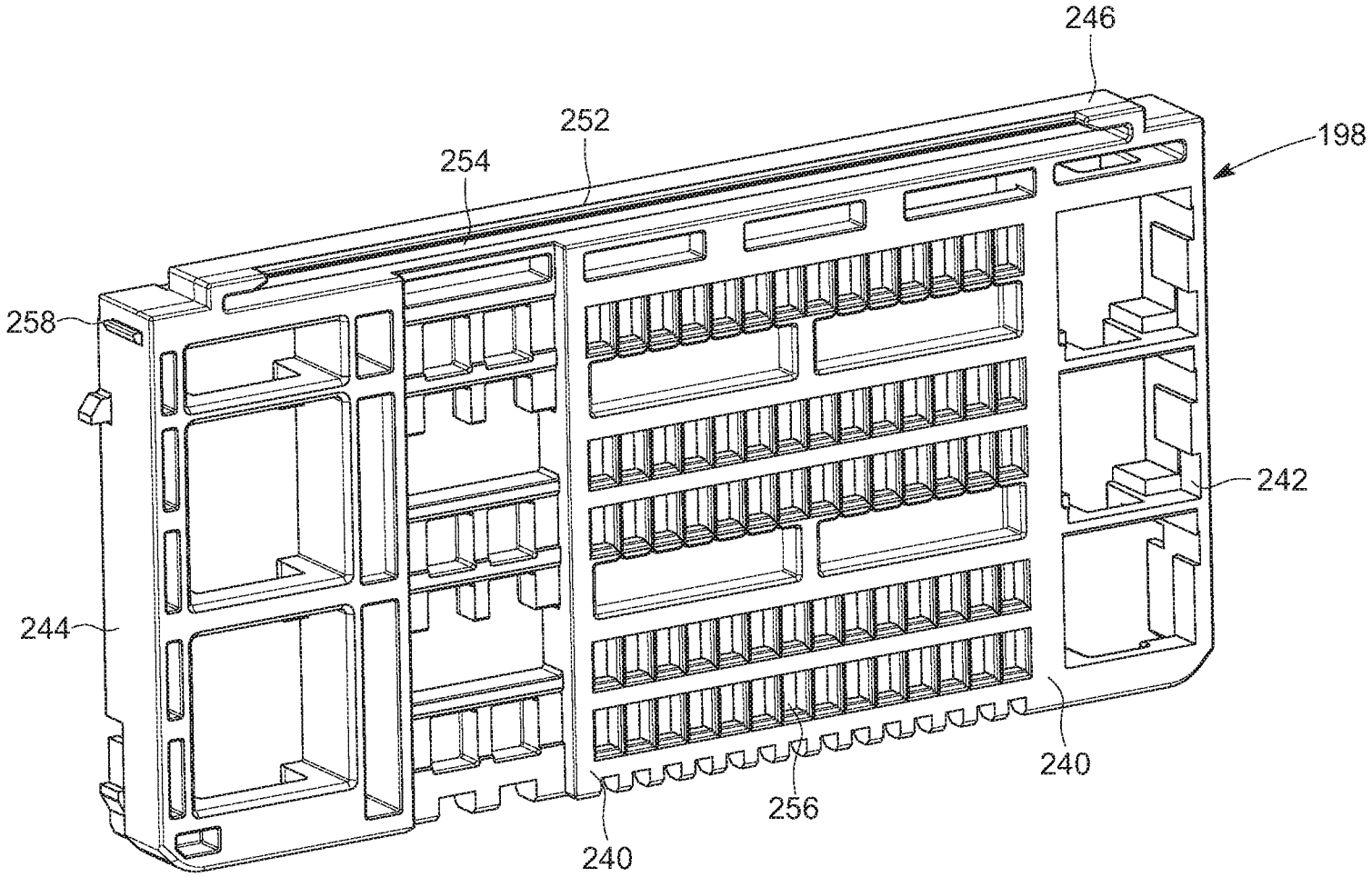
FIG. 24 depicts a perspective elevation of the independent secondary lock, viewed from a bottom thereof.

As best shown in FIGS. 21 and 22, the upper terminal housing 190 is generally rectangular and has a rectangularly shaped base wall 202 having front, rear and side walls 204, 206, 208, 210 extending upwardly and downwardly from the outer perimeter thereof, such that an open-topped upper cavity 212 is formed above the base wall 202 and an open-bottom lower cavity 214 is formed below the base wall 202. A longitudinal axis of the upper terminal housing 190 extends between the front wall 204 and the rear wall 206. The base wall 202 includes a plurality of apertures 216 therethrough which extend from an upper face to a lower face thereof and which are perpendicular to the longitudinal axis. The side wall 208 has an elongated slot 218 which extends longitudinally along the side wall 208 and which is in communication with the lower cavity 214. A front latch arm 220 extends rearwardly from the front wall 204 and into the slot 218. A rear latch arm 222 extends forwardly from the rear wall 206 and into the slot 218. Each latch arm 220, 222 is flexible and has a barbed end 224 at the end thereof. The barbed ends 224 face each other. The side wall 210 has an elongated slot 226 which extends longitudinally along the side wall 208 and which is in communication with the lower cavity 214. The slots 218, 226 are vertically aligned with each other. A shoulder 228 is formed in the walls 204, 206, 208, 210 above the slots 218, 226.

Figure 25:
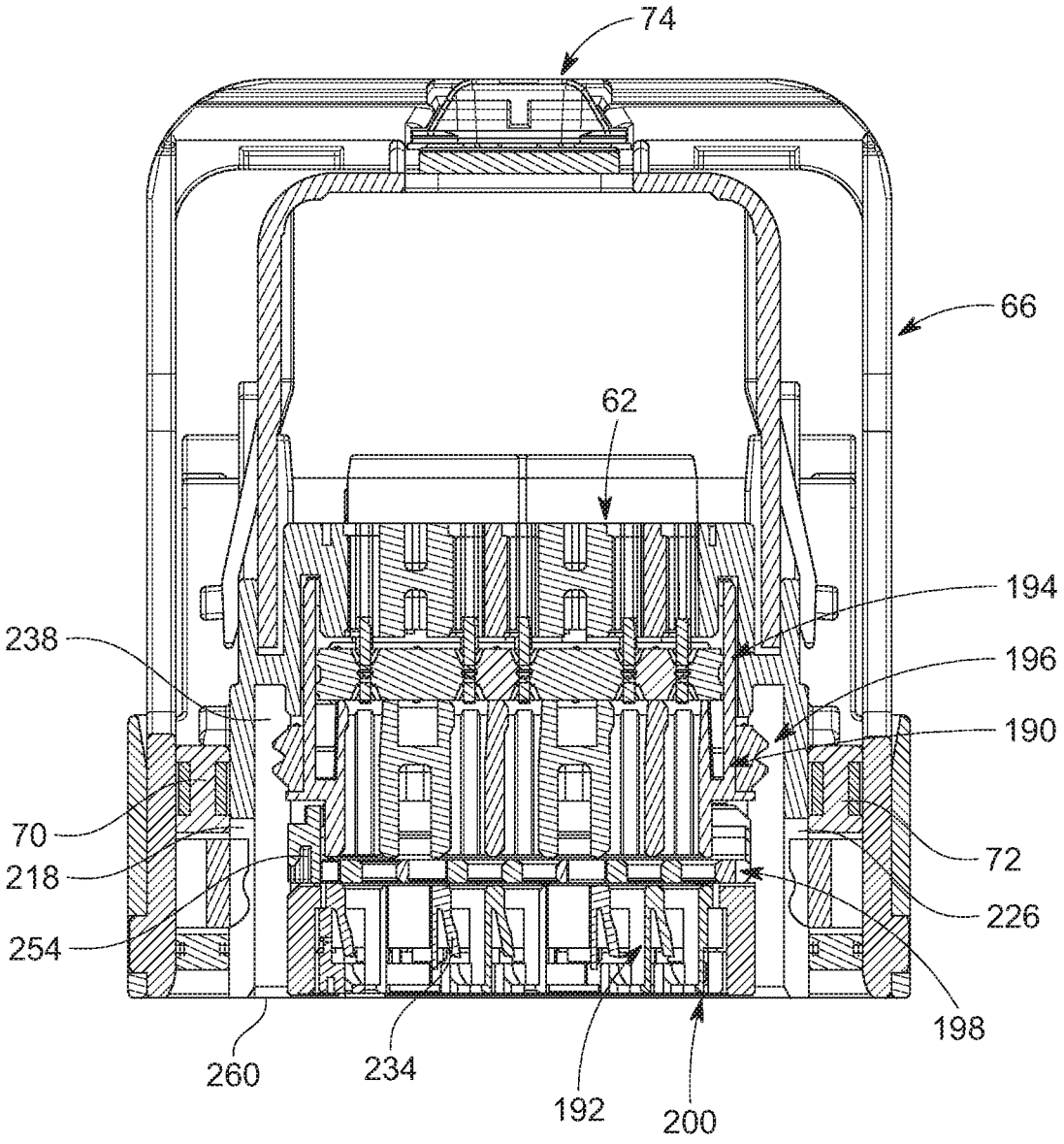
FIG. 25 depicts a cross-sectional of the actuator connector.

The mat seal 194 seats within the upper cavity 212 and proximate to an upper surface of the base wall 202, see FIGS. 22 and 25. The mat seal 194 is flat and has a plurality of apertures 230 therethrough which extend from an upper face to a lower face thereof. The mat seal 194 seals to inner surfaces of the walls 204, 206, 208, 210.

The lower terminal housing 192 seats within the lower cavity 214 below the slots 218, 226, see FIGS. 22 and 25. The lower terminal housing 192 is flat and has a plurality of apertures 232 therethrough which extend from an upper face to a lower face thereof. Each aperture 232 has a flexible locking finger 234 which extends therein and is configured to engage with the terminal to form a primary lock.

The lower cover 200 seats within the lower cavity 214 below the lower terminal housing 192, see FIGS. 22 and 25. The lower cover 200 is flat and has a plurality of apertures 236 therethrough which extend from an upper face to a lower face thereof. Suitable latches are provided between the lower cover 200 and the lower terminal housing 192 and between the lower cover 200 and the upper terminal housing 190 to retain lower terminal housing 192 and the lower cover 200 in the upper terminal housing 190.

A stop surface is formed in the lower terminal housing 192 or in the lower cover 200 that includes a forward located shoulder portion that engages a cooperating surface formed on a nose portion of the terminal. The shoulder portion creates a front stop to limit the insertion of each terminal within the terminal retention portion 68.

The apertures 216, 230, 232, 236 align with each other such that a terminal can be inserted through the mat seal 194, the base wall 202, the lower terminal housing 192 and the lower cover 200.

Figure 19:
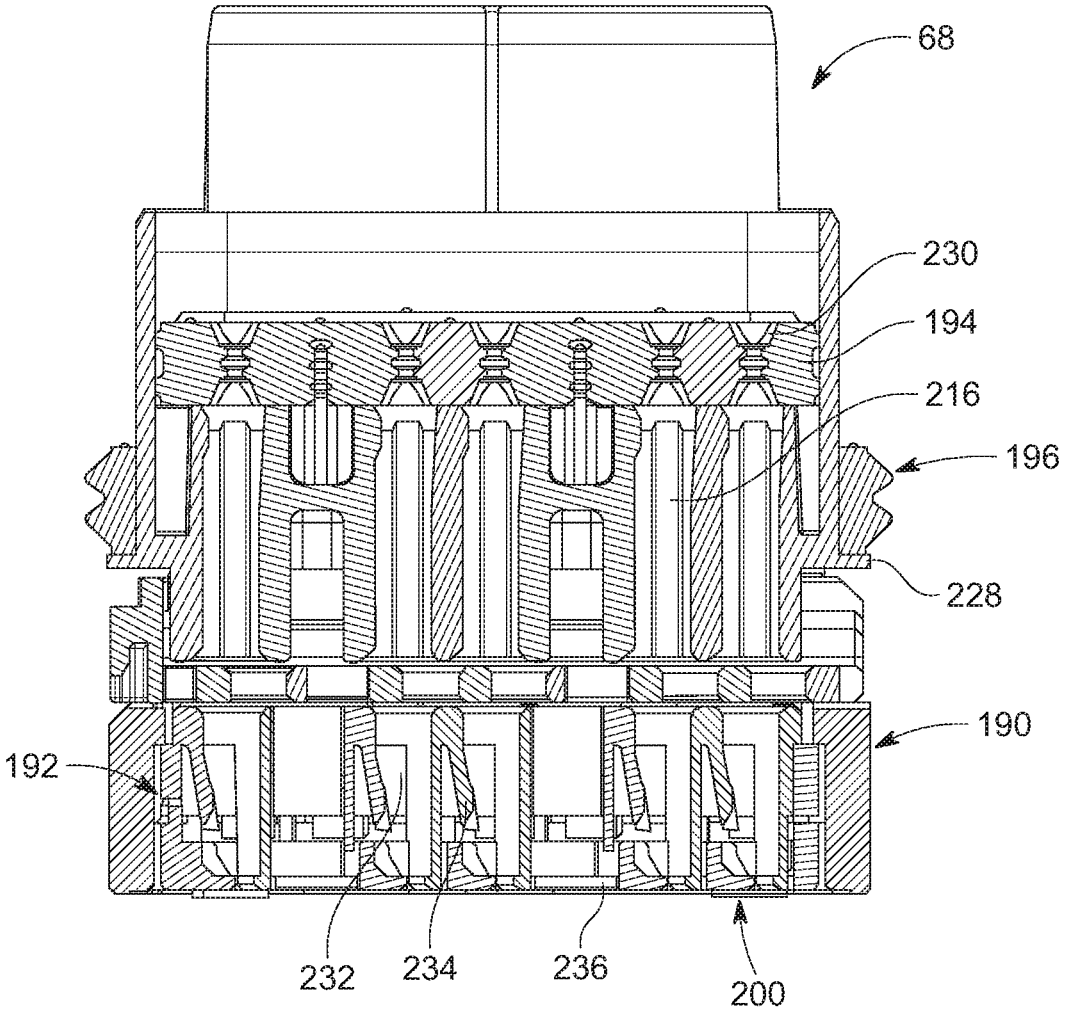
FIG. 19 depicts a cross-sectional of the terminal retention portion.
Figure 20:
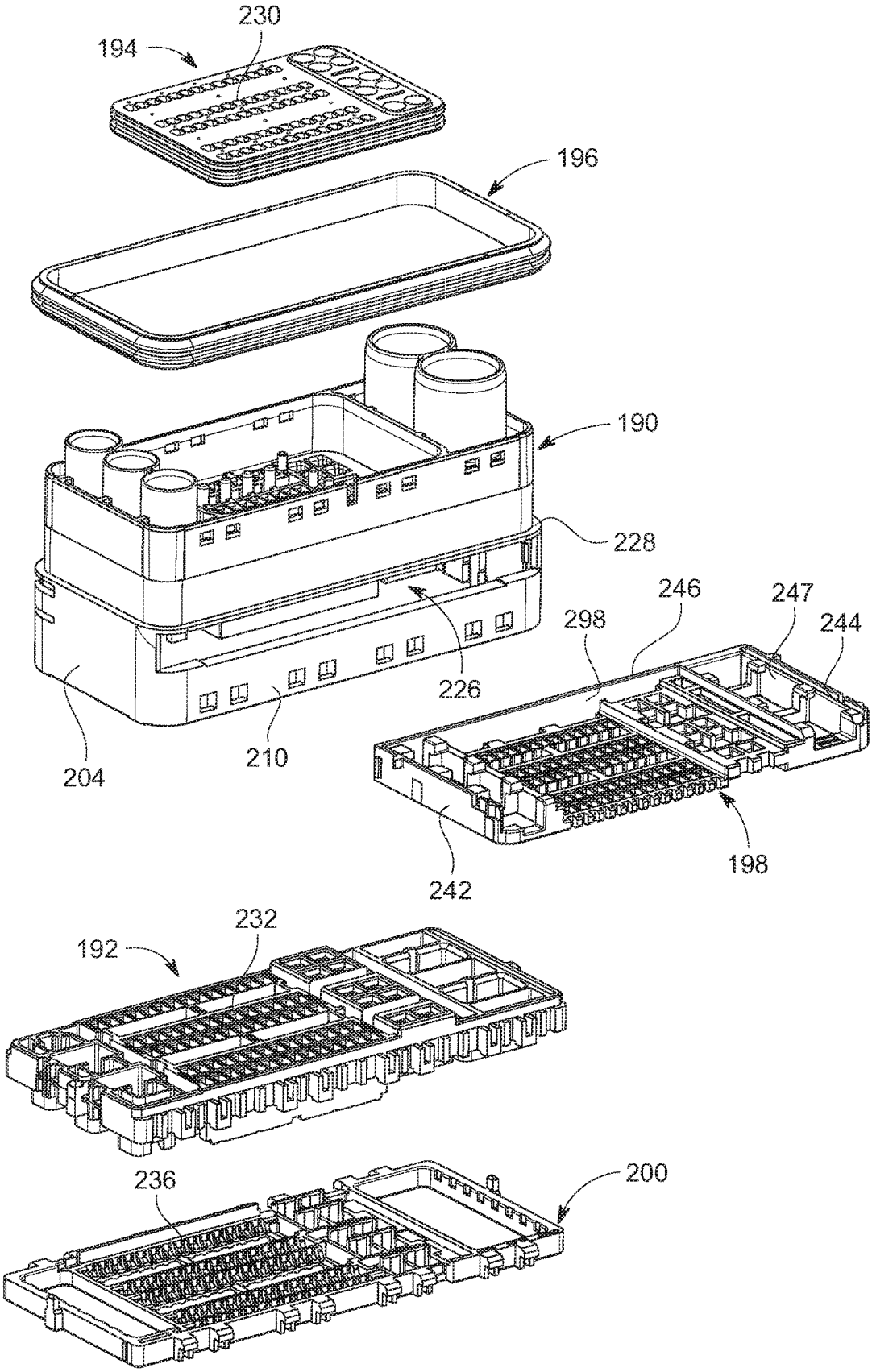
FIG. 20 depicts an exploded front perspective view of the terminal retention portion.

The perimeter seal 196 extends around the walls 204, 206, 208, 210 of the upper terminal housing 190 and sits on the shoulder 228 and above the shoulder 228, see FIG. 19. The perimeter seal 196 has a plurality ribs on its external surface.

When the terminal retention portion 68 is assembled with the connector housing 62, the mat seal 194 is proximate to base wall 82 of the connector housing 62, and the passageways 96 through the base wall 82 and the apertures 216, 230, 232, 236 align with each other. The walls 204, 206, 208, 210 of the upper terminal housing 190 are spaced from the walls 84, 86, 88, 90 of the connector housing 62 such that a space 238, see FIG. 25, is provided. The perimeter seal 196 extends into the space 238.

Figure 25A:
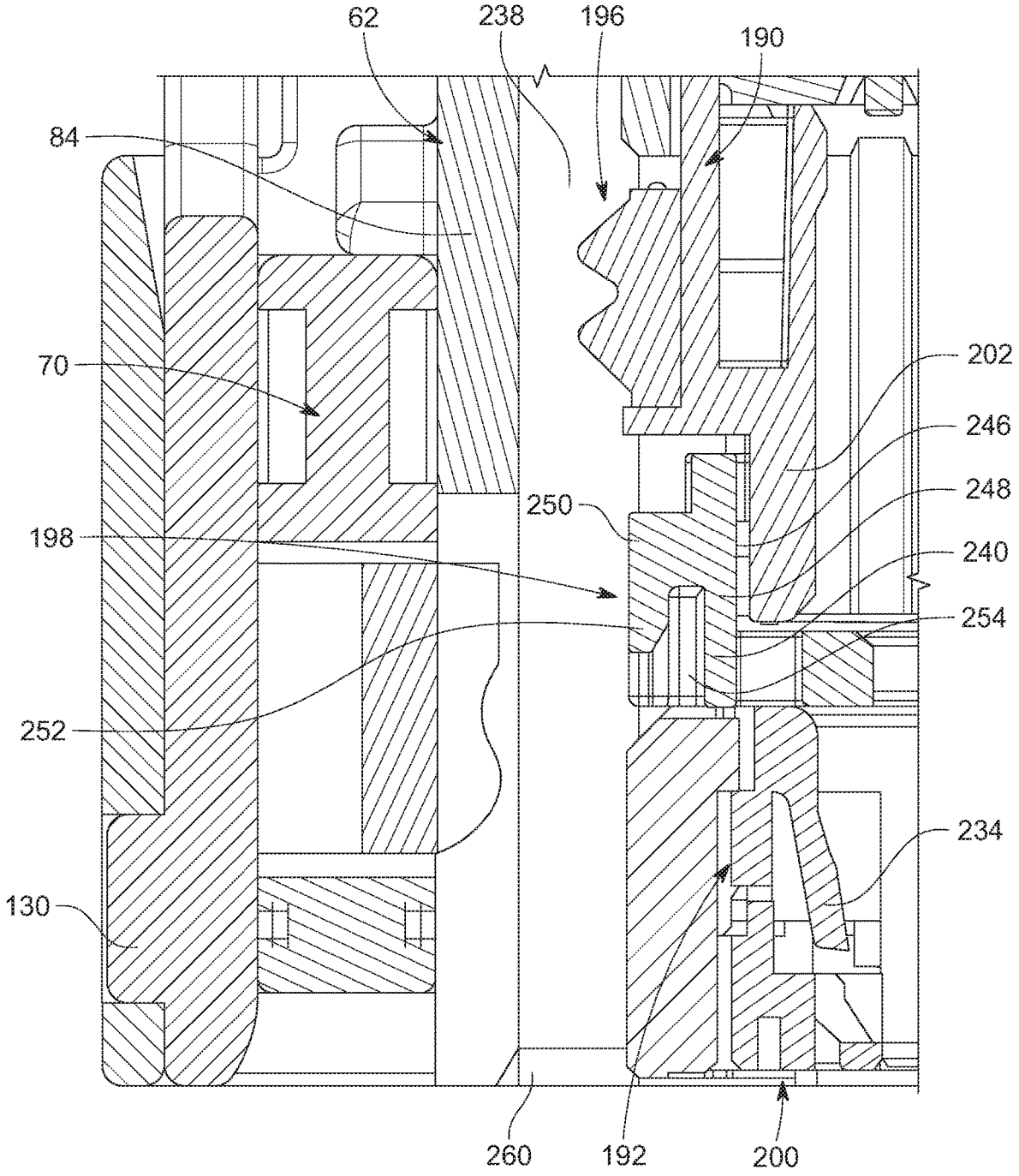
FIG. 25A depicts an enlarged partial cross-sectional of the actuator connector showing a portion of FIG. 25.

The independent secondary lock 198 is mounted in the lower cavity 214 and in the slots 218, 226, and is between a lower surface of the base wall 202 and an upper surface of the lower terminal housing 192, see FIGS. 21 and 25. The independent secondary lock 198 has a rectangularly shaped base wall 240, a front wall 242 extending upward from a front end thereof, a rear wall 244 extending upward from a rear end thereof, and a side wall 246 extending upward from a side edge of the base wall 240 and extending between the front and rear walls 242, 244. The walls 240, 242, 244 form an open-topped three-sided cavity 247. The side wall 246 has a first vertical wall portion 248 which extends upward from the base wall 240, a second horizontal wall portion 250 which extends outwardly from the first vertical wall portion 248 and is perpendicular thereto, and a third vertical wall portion 252 which extends downward from the outer end of the second wall portion 250, is perpendicular thereto, and is parallel to the first wall portion 248, such that an elongated slot 254 is formed by the side wall 246. In cross-section, as shown in FIG. 25A, the slot 254 is T-shaped. The base wall 240 has a plurality of apertures 256 therethrough which extend from an upper face to a lower face thereof. Each of the front and rear walls 242, 244 have a protrusion 258 extending outwardly therefrom proximate to the side wall 246.

To assemble the independent secondary lock 198 with the remainder of the terminal retention portion 68, the independent secondary lock 198 is inserted through the slot 218 of the upper terminal housing 190 and into the lower cavity 214 and into a first position. The base wall 202 of the upper terminal housing 190 seats within the three-sided cavity 247 of the independent secondary lock 198, and an inner surface of the side wall 246 of the independent secondary lock 198 engages against a side surface of the base wall 202 of the upper terminal housing 190. The latch arms 220, 222 flex outwardly from the slot 219 when the barbed ends 224 engage with the protrusions 258, but the latch arms 220, 222 snap back into place once the protrusions 258 pass the barbed ends 224. In this first position, a terminal cannot be passed through the terminal retention portion 68; a wall forming the apertures 256 in the independent secondary lock 198 block the aligned apertures 216, 230, 232, 236 in the mat seal 194, the upper terminal housing 190, the lower terminal housing 192 and the lower cover 200.

Once the terminal retention portion 68 is assembled, the terminal retention portion 68 is inserted into the cavity 92 of the connector housing 62 to form the actuator connector 22 and the space 238 is formed. A lower opening 260, see FIG. 25, is formed at the lower end of the actuator connector 22. Suitable latch structures are provided between the upper terminal housing 190 and the connector housing 62 to retain the terminal retention portion 68 in the connector housing 62.

In order to permit the passage of terminals through the actuator connector 22, the independent secondary lock 198 must be shifted relative to the upper terminal housing 190 to a second position, such that the walls forming the apertures 256 in the independent secondary lock 198 are misaligned with the aligned apertures 216, 230, 232, 236 in the mat seal 194, the upper terminal housing 190, the lower terminal housing 192 and the lower cover 200, such that the apertures 256 in the independent secondary lock 198 aligned with the aligned apertures 216, 230, 232, 236. To affect this, a pry tool (not shown) is inserted through the lower opening 260 and into the space 238. The pry tool can have a hooked end and engages within the slot 254 and with the wall portion 252 of the independent secondary lock 198. In the view shown in FIG. 25, the independent secondary lock 198 is pulled by the pry tool to shift the independent secondary lock to the right and into the second position, and the pry tool is removed. Enough force is exerted on the independent secondary lock 198 such that during this movement to the second position, the protrusions 258 on the independent secondary lock 198 bias the latch arms 220, 222 outwardly to allow the independent secondary lock 198 to extend into the space 238, and thereby align the apertures 216, 230, 256, 232, 236 in the mat seal, the upper terminal housing 190, the independent secondary lock 198, the lower terminal housing 192 and the lower cover 200. Thereafter, the terminals are inserted (the wire dress cover 64 needs to be removed to insert the terminals) through the now aligned apertures 216, 230, 256, 232, 236. The mat seal 194 sealingly engages the terminals to provide a moisture and debris barrier and to assist in providing a sealed system. The terminals are advanced until the terminals engage with the locking fingers 234 in the lower terminal housing 192.

Upon complete insertion of the terminals, the independent secondary lock 198 is moved from the second position back to the first position by use of the pry tool. The pry tool is again inserted through the lower opening 260 and into the space 238, and is engaged within the slot 254 and with the wall portion 248 of the independent secondary lock 198. In the view shown in FIG. 25, the independent secondary lock 198 is pushed by the pry tool to shift the independent secondary lock to the right. After the independent secondary lock 198 is moved back into the first position, the pry tool is removed. The wire dress cover 64 is attached. The walls forming the apertures 256 in the independent secondary lock 198 form stop surfaces which engages with cooperating stop surfaces formed on the terminals. This further locks the terminals within the actuator connector 22 and provides a secondary lock that further restricts the terminals from being withdrawn from the actuator connector 22. In the first position, the independent secondary lock 198 does not protrude outwardly of the upper terminal housing 190.

On occasions, terminals may need to be serviced, and in such cases, the terminals need to be removed from the actuator connector 22. The terminals can be removed from the actuator connector 22 by removing the wire dress cover 64, releasing the locking fingers 234 in the lower terminal housing 192 from the terminals, shifting the independent secondary lock 198 to the second position as described herein, and pulling the terminals out of the aligned apertures 216, 230, 256, 232, 236 in the mat seal 194, the upper terminal housing 190, the independent secondary lock 198, the lower terminal housing 192 and the lower cover 200. A new terminal can then be reinserted into the actuator connector 22 in the manner described herein.

When the mating connector 24 is inserted into the actuator connector 22, the walls 30, 32, 34, 36 of the plug housing 26 pass through the opening 260 and into the space 238. The walls 30, 32, 34, 36 sealingly engages with the perimeter seal 196, thereby providing a completely sealed system.

It will be understood that there are numerous modifications of the illustrated embodiments described above which will be readily apparent to one skilled in the art, such as many variations and modifications of the lever-type electrical connector assembly 20 and/or its components including combinations of features disclosed herein that are individually disclosed or claimed herein, explicitly including additional combinations of such features, or alternatively other types of contact array connectors. Also, there are many possible variations in the materials and configurations.

The disclosure provided herein describes features in terms of preferred and exemplary embodiments thereof. Numerous other embodiments, modifications and variations within the scope and spirit of the appended claims will occur to persons of ordinary skill in the art from a review of this disclosure.

The invention claimed is:

1. An electrical connector comprising:

a first housing configured to mate with a second housing, the first housing having a front end and an opposite rear end;

a pair of slide members movably mounted on the first housing, each slide member having first and second side surfaces, a cam groove in the first side surface and extending from a bottom end of each slide member and upwardly and forwardly toward a front end of each slide member, the cam groove having a base wall parallel to the first side surface, and front and rear walls extending from the base wall to the first side surface, the rear wall having a lead-in surface proximate to an opening of the cam groove and which is angled relative to a longitudinal axis of the respective slide member, the front and rear walls having cam surfaces configured for engagement with a cam follower post of the second housing, the cam surface of the rear wall extending from the lead-in surface, and a blocking shoulder extending rearwardly from the front wall, the blocking shoulder partially blocking the opening of the cam groove, the lead-in surface and the blocking shoulder being configured for engagement with the cam follower post of the second housing; and a lever pivotably attached to the first housing and slidably coupled to the slide members, the lever being movable between a ready-to-mate position wherein the lever is proximate to the front end of the first housing and a mated position wherein the lever is proximate to the rear end of the first housing, wherein each lead-in surface is angled relative to the longitudinal axis at an angle of the respective slide member which is greater than an angle at which the rear wall of each blocking shoulder is angled relative to the longitudinal axis of the respective slide member.

2. The electrical connector of claim 1, wherein each blocking shoulder includes a side wall which extends rearwardly from the front wall and is parallel to the base wall and the first side surface, a bottom wall which extends from a bottom end of the respective slide member, and a rear wall which extends outwardly from the base wall to the side wall.

3. The electrical connector of claim 1, wherein the lead-in surface of each rear wall extends upwardly and forwardly, and the rear wall of each blocking shoulder is angled relative to the longitudinal axis of the respective slide member such that the rear wall of each blocking shoulder extends upwardly and forwardly.

4. The electrical connector of claim 1, wherein each slide member has a pair of cam grooves in the first side surface.

5. The electrical connector of claim 1, wherein each slide member includes a vertical groove, and the lever includes a pair of arms extending downward from a cross portion, each arm including a projection vertically slidable within the respective vertical groove.

6. The electrical connector of claim 1, further comprising a terminal retention portion mounted within a cavity of the first housing, the terminal retention portion including a terminal housing through which terminals can pass, wherein a space is formed between the terminal housing and the first housing which can be accessed through an opening into the cavity, a first seal attached to the terminal housing and configured to engage with the terminals, and a second seal attached to the terminal housing and which is configured to engage with the second housing.

7. The electrical connector of claim 6, wherein the terminal retention portion further comprises an independent secondary lock attached to the terminal housing and through which terminals can pass, the independent secondary lock being movable relative to the terminal housing and into the space, and further the independent secondary lock being movable relative to the terminal housing and into engagement with the terminals.

8. The electrical connector of claim 7, wherein the terminal housing includes releasable locking fingers configured for engagement with the terminals.

9. An electrical connector comprising:

a first housing configured to mate with a second housing, the first housing having a front end and an opposite rear end;

a pair of slide members movably mounted on the first housing, each slide member having first and second side surfaces, a cam groove in the first side surface and extending from a bottom end of each slide member and upwardly and forwardly toward a front end of each slide member, the cam groove having a base wall parallel to the first side surface, and front and rear walls extending from the base wall to the first side surface, the rear wall having a lead-in surface proximate to an opening of the cam groove and which is angled relative to a longitudinal axis of the respective slide member, the front and rear walls having cam surfaces configured for engagement with a cam follower post of the second housing, the cam surface of the rear wall extending from the lead-in surface, and a blocking shoulder extending rearwardly from the front wall, the blocking shoulder partially blocking the opening of the cam groove, the lead-in surface and the blocking shoulder being configured for engagement with the cam follower post of the second housing;

a lever pivotably attached to the first housing and slidably coupled to the slide members, the lever being movable between a ready-to-mate position wherein the lever is proximate to the front end of the first housing and a mated position wherein the lever is proximate to the rear end of the first housing; and a terminal retention portion mounted within a cavity of the first housing, the terminal retention portion including a terminal housing through which terminals can pass, wherein a space is formed between the terminal housing and the first housing which can be accessed through an opening into the cavity, a first seal attached to the terminal housing and configured to engage with the terminals, and a second seal attached to the terminal housing and which is configured to engage with the second housing, wherein the terminal retention portion further comprises an independent secondary lock attached to the terminal housing and through which terminals can pass, the independent secondary lock being movable relative to the terminal housing and into the space, and further the independent secondary lock being movable relative to the terminal housing and into engagement with the terminals, and wherein the independent secondary lock includes an elongated slot therein in communication with the space and which can be engaged by a pry tool to move the independent secondary lock relative to the terminal housing.

10. The electrical connector of claim 9, wherein the slot is generally T-shaped.

11. An electrical connector assembly comprising:

a mating connector comprising a housing having a cam post extending outwardly therefrom, the cam post having a main body and a projection extending therefrom;

an actuator connector comprising a housing having a front end and an opposite rear end, a pair of slide members movably mounted on the housing of the actuator connector, each slide member having first and second side surfaces, a cam groove in the first side surface and extending from a bottom end of each slide member and upwardly and forwardly toward a front end of each slide member, the cam groove having a base wall parallel to the first side surface, and front and rear walls extending from the base wall to the first side surface and forming cam surfaces, the rear wall having a lead-in surface proximate to an opening of the cam groove and which is angled relative to a longitudinal axis of the respective slide member, the cam surface of the rear wall extending from the lead-in surface, and a blocking shoulder extending rearwardly from the front wall, the blocking shoulder partially blocking the opening of the cam groove, and a lever pivotably attached to the housing of the actuator connector and slidably coupled to the slide members, the lever being movable between a ready-to-mate position wherein the lever is proximate to the front end of the housing of the actuator connector and a mated position wherein the lever is proximate to the rear end of the housing of the actuator connector; and wherein the main body is capable of being engagement with the lead-in surface and capable of being engagement with the cam surfaces, and the projection is capable of being in engagement with the blocking shoulder, wherein the projection is crescent-shaped, and wherein the main body has an outer surface which falls along a radius, and the projection has a curved surface which falls along a radius which is the same as the radius of the main body, the outer surface being capable of being engaged with the cam surfaces, and the curved surface being capable of being engaged with the blocking shoulder and one of the cam surfaces.

12. The electrical connector assembly of claim 11, wherein the projection has a convex surface being capable of being engaged with the blocking shoulder external to the respective slide member.

13. The electrical connector assembly of claim 11, wherein the projection has a concave surface capable of being engaged with the lead-in surface.

14. The electrical connector assembly of claim 11, wherein each slide member has a pair of cam grooves.

* * * * *